US008141493B1

(12) United States Patent
Kuchman

(10) Patent No.: US 8,141,493 B1
(45) Date of Patent: Mar. 27, 2012

(54) PROJECTILE FOR USE WITH A RIFLED BARREL

(76) Inventor: Todd Kuchman, Greeley, CO (US)

( * ) Notice: Subject to any disclaimer, the term of this patent is extended or adjusted under 35 U.S.C. 154(b) by 0 days.

(21) Appl. No.: 13/131,440

(22) PCT Filed: Nov. 2, 2010

(86) PCT No.: PCT/US2010/055150

§ 371 (c)(1),
(2), (4) Date: May 26, 2011

(51) Int. Cl.

| | |
|---|---|
| ***F42B 10/26*** | (2006.01) |
| ***F42B 10/48*** | (2006.01) |
| ***F42B 10/54*** | (2006.01) |
| ***F42B 12/66*** | (2006.01) |

(52) U.S. Cl. ..... 102/439; 102/501; 102/517

(58) Field of Classification Search ..... 102/438, 102/439, 457, 501, 503, 504, 506, 507, 508, 102/516, 517; 244/3.23
See application file for complete search history.

(56) References Cited

U.S. PATENT DOCUMENTS

| | | | | |
|---|---|---|---|---|
| 39,282 A | | 7/1863 | Ganster | |
| 1,198,035 A | | 9/1916 | Huntington | |
| 1,536,164 A | | 5/1925 | Tainton | |
| 2,372,383 A | | 3/1945 | Lee | |
| 3,085,510 A | * | 4/1963 | Campbell | 102/456 |
| 4,664,034 A | | 5/1987 | Christian | |
| 4,726,543 A | * | 2/1988 | Stessen | 244/3.1 |
| 5,315,932 A | * | 5/1994 | Bertram | 102/457 |
| 5,698,815 A | | 12/1997 | Ragner | |
| 6,381,894 B1 | * | 5/2002 | Murphy | 42/77 |

FOREIGN PATENT DOCUMENTS

| | | |
|---|---|---|
| FR | 2874254 | 2/2006 |
| GB | 2386673 | 9/2003 |
| WO | WO 2006/115854 | 11/2006 |

OTHER PUBLICATIONS

International Search Report prepared by the U.S. Patent and Trademark Office on Jan. 11, 2011 for PCT/US2010/055150; Applicant: Advanced Ballistic Concepts LLC.
Australia Examiner's Report prepared by the Australian Patent Office on Jan. 17, 2011 for Australia Patent Application No. 2010257280; Applicant: Advanced Ballistic Concepts LLC.

* cited by examiner

*Primary Examiner* — James Bergin
(74) *Attorney, Agent, or Firm* — Sheridan Ross P.C.

(57) ABSTRACT

A multi-component projectile is disclosed. The multi-component projectile is designed for use with a rifled barrel and is configured to, upon exiting the rifled barrel, utilize the spinning forces imparted on the projectile while in the barrel to expand until the multi-component projectile achieves a predetermined pattern that is larger than an area of the barrel from which the projectile was fired. Methods of manufacturing the multi-component projectile are also disclosed.

18 Claims, 27 Drawing Sheets

PROJECTILE FOR USE WITH A RIFLED BARREL

CROSS REFERENCE TO RELATED APPLICATION

This application is a national stage application under 35 U.S.C. 371 of PCT Application No. PCT/US2010/055150 having an international filing date of Nov. 2, 2010, which designated the United States, the entire disclosure of each of which is hereby incorporated herein by reference.

The present disclosure is generally directed toward projectiles for use with rifled barrels and methods of manufacturing the same.

BACKGROUND

It is well understood by those skilled in the art of weaponry that firearms typically fall into two separate families, those being: smooth bore and rifled bore. A smooth bore was the original design of all early firearms (cannons and hand held guns) smooth bore barrels fire mono- or multi-projectile shot without inducing a spin. The most recognized non-spinning mono projectiles would be fired from a colonial smooth bore musket, (i.e., the sphere configuration dominated in popularity and then the min-ball (a more aerodynamically shaped version)). Due to the advent of the second member of the firearm family, the rifled barrel, a superior method of firing a mono-projectile with a predictable flight path was achieved and the practice of firing slugs form a smooth boor is all but forgotten.

In contrast, most modern marksmen frequently use smooth bore barrels to fire non-spinning multi-projectile shot as buckshot or birdshot, which are most often referred to as "scatter shot" due to the reliance on random events/influences to cause a spreading out of the plurality of projectiles. This shot type was originally referred to as "scatter-shot" because it relies on random influences (e.g., wind, barometric pressure, temperature, velocity, collisions, turbulence, etc.) to achieve a random but semi-predictable rate/pattern of ever expanding separation. As the plurality of projectiles travel down the barrel of the gun and further travel down range toward the target, the spreading out of the projectiles occurs randomly and simultaneously on all three axes X,Y,Z (vertical, horizontal and depth). Because of the three axes random separation, this type of shot is most effective only at semi-close range engagements of 10 to 40 yards. Unfortunately, under ten yard the spread pattern is nominal and offers little advantage if any over a mono-projectile, and beyond 40 yards large gaps between projectile segments develop unpredictably thereby reducing probability as they continue to spread indefinitely.

As marksmen became increasingly frustrated with the limitations of the predictability of flight paths (accuracy) of mono-projectiles fired from smooth bored firearms, rifled bore firearms were created. Barrel rifling is a relatively simple modification to a standard gun barrel but the effects of the rifling resulted in a quantum leap forward in improving the predictably of the flight path of a mono-projectile fired from it; the accuracy benefit is due primarily to the gyroscopic stabilization gained as a result of spin imparted to the projectile as it contacts the grooves and lands of the rifling pattern while the bullet travels the length of the barrel. To clarify, the improved predictability (accuracy) is achieved by imparting a spin to the projectile as it rubs against the riffling in the barrel prior to it leaving the tip of the gun. This spin gyroscopically stabilizes the projectile as it travels down range.

The rifled bore group of firearms is commonly divided into four sub-categories: 1) Small caliber weapons using ammunition ranging in size from 0.22 inch which are commonly fired from small handguns; 2) Small arms weapons which use straight sided centre fire ammunition, the ammunition being fired from handguns and semi-automatic guns, the common bores being 0.38 inch, 0.357 inch, .45 cal, 0.44 inch, 9 mm and 10 mm which offer accuracy over a range up to 50 meters; 3) Combat rifles which fire ammunition sending projectiles at very high velocities over ranges of 500 meters plus, the common bores being 0.223 inch (5.56 mm), 5.7 mm, 0.303 inch, 7.62 mm and 0.50 inch; and 4) Heavy weapons for firing ammunition up to 2 kilometers commonly having bores of 20 mm, 30 mm and larger, and which are used in extreme range combat to deliver large payloads.

While the spin-rates, muzzle velocities, bore diameters, and other parameters of the above-mentioned four sub-categories of rifled firearms vary from firearm to firearm, there is one common theme among the design of these firearms—all rifled fireams are designed to deploy a single spinning projectile that is designed to remain whole, and not materially expand or distort from it aerodynamic shape (regardless of the amount of centrifugal force exerted on it) until it collides with a target.

Since smooth bore and rifled firearms both have design advantages and disadvantages, one type of firearm may be preferable for a certain situation (e.g., shotguns may be desirable in mid-range engagements, 20 to 100 feet (combat or hunting of pray) whereas another type of firearm may be preferable for other situations (e.g., rifled firearms such as pistols may be desirable for ultra-close range engagements of 0 to 20 feet or long barreled riles may be desirable for long range engagements of 100 yards and beyond). However, since it is often impracticable or impossible to carry/use multiple types of firearms at the same time, most people are automatically limited by the type of firearm which they are carrying, and in turn they are further limited by the type of shot they can fire.

SUMMARY

It is, therefore, one aspect of the present disclosure to provide multi-projectile ammunition designed to be fired from a rifled firearm (or any other type of firearm which imparts a gyroscopically-stabilizing spin on projectiles fired therefrom) which is not only designed to emulate the increased hit probability of smooth bore-based multi-projectiles, but also improve the performance of the projectile it at ultra-close and long-range engagements. Moreover, since the ammunition described herein benefits form the spin generated forces produced by a rifled firearm, many of the disadvantages associated with the use of a multi-projectile scatter-shot (e.g., random separation on three axis's, random grouping of segments (clusters), infinite separation potential, undesired gaps between segments at longer ranges, slow rate of radial expansion, random flight path of any given projectile segment and limited effective range) can be overcome.

In accordance with at least some embodiments of the present disclosure, ammunition (also referred to as a round, cartridge, or cartridge assembly) for a rifled firearm is provided which includes a projectile assembly having at least a first and second projectile portion which interlock to assure a simultaneous departure from the gun barrel. In some embodiments, the projectile assembly further includes an interconnecting member which interconnects the plurality of projectile portions of the projectile assembly. As the projectile assembly is fired and travels down bore of the rifled firearm, the projectile assembly begins to spin. Also, due to the confinement within the barrel, the portions of the projectile assembly maintain their interlocked relationship regardless of spin generated forces. However, once the projectile assembly exits the barrel of the firearm, the spinning forces imparted on the projectile assembly by the rifling causes the previously interlocked portions of the projectile to simultaneously move rapidly outward (radial movement) away from their original center of rotation (which is coincident with an original trajectory of the projectile assembly as well as the center axis of the barrel).

In some embodiments, the portions of the assembly may be uniformly constructed. Due to the synchronized movement assured by the uniformity of the portions and the simultaneous departure from the barrel, the portions create a uniform spacing form one another while the projectile assembly spreads out as it continues to travel along its original trajectory path away from the barrel. As the projectile assembly travels down range away from the barrel of the firearm, and the spin generated forces move the pre-fragmented pieces away from their center of rotation, a multi-staged tether/brake system, originally housed within a protective cavity formed by the assembly of interlocking segments begins to emerge, at first intentionally offering little resistance to slow down the rapid outward rate of expansion. This intentional delay in the application of a radial movement breaking force is to allow for the most rapid possible separation of the individual segments form the original center of rotation to increase the area of influence (hit probability) in ultra-close engagements.

After the initial delay, the tether/brake system enters a second phase, and begins to arrest the outward movement of the portions by applying small incremental amounts resistance that collectivity counter the vast majority if not all of the pulling force exerted on the tether/brake system. If additional radial movement persists beyond deployment of the second phase, an additional phase of the braking system activates. In some embodiments, this additional phase of braking utilizes a deformation brake which arrests the balance of the pulling force and along with the ever present centrifugal force inherent in the spinning assembly segments, the portions lock into orbit around their original center of rotation and the projectile assembly is gyroscopically stable. The now separated portions locked into a spin-stabilized orbit at a fixed distance from center and each other respectively and continue down range in a predetermined spread pattern until some or all of the projectile assembly strikes an object or falls to the ground.

When this projectile assembly is fired from a rifled barrel, the portions automatically deploy into a pre-defined maximum diameter and pattern of spread in a predictable precise manner. The assembly's design harnesses spin-generated forces to first allow for a rapid outward radial spread (four times faster rate of expansion than traditional buckshot), and then uses a multi-staged braking and tether restraint system to arrest and suspend the portions into orbit at a fixed distance around their original center of rotation.

In some embodiments, the projectile assembly may include more than a first and second projectile portion. For example, the projectile assembly may include a first, second, and third projectile portion. In another example, the projectile assembly may include a first, second, third, and fourth projectile portion. In another example, the projectile assembly may include a first, second, third, fourth and fifth projectile portion. The configuration of the tether may vary depending on the number of projectile portions in the projectile assembly.

In some embodiments, the tether/brake system may comprise a number of arms which are interconnected at a central point. Each projectile portion of the projectile assembly may have an arm of the tether/brake system connected thereto. In some embodiments, each projectile portion comprises a via through which an arm of a tether passes through. The configuration of the via may be such that the tether arm is retained in the via even when pulling forces are applied to the tether arm. Accordingly, the weight and expanding forces of a single projectile portion are used to slow down the rate at which the other projectile portions are expanding away from the original center of trajectory of the projectile assembly. By providing symmetric projectile portions, meaning that each projectile portion of the projectile assembly has the virtually the same weight and physical properties, each projectile portion and its respective interconnected tether will function as a counter force allow the simultaneous pulling force of the additional apposing tether/segment in the assembly to deploy at the same rate and manner of deceleration allowing for a uniform and stable orbit to be obtained.

In some embodiments, the tether/brake system is configured such that a plurality of braking forces are sequentially applied to each projectile portion as the projectile portions expand away from their center of rotation substantially within a single plane of expansion and wherein a trajectory of the multi-projectile assembly is substantially orthogonal to the plane of expansion.

In some embodiments, the tether is configured to first allow the projectile portions to expand away from their center of rotation with an increasing rate of velocity for a first predetermined amount of time (or up to a predetermined distance). Thereafter, the tether/brake system is configured to start applying a first set of braking forces equally to all projectile portions. The first set of braking forces begin to decrease the rate of velocity with which the projectile portions expand away from their original center of rotation. The first set of braking forces are applied to the projectile portions for a second amount of time. Thereafter, the tether/brake system is configured to start applying a second braking force equally to all projectile portions. The second braking force is applied to the projectile portions after the first amount of time and after the second amount of time. The second braking force along with the outstretched tether ultimately causes the projectile portions to stop expanding away from one another and their center of rotation. The sequential application of the first set of braking forces and then the second braking force allows the deceleration of the projectile portions to be controlled, thereby maintaining a stable trajectory of the projectile assembly as it travels away from the barrel of the firearm as well as a stable orbit of the projectile portions. More specifically, the tether/brake system enables the projectile assembly to benefit from the gyroscopic stabilization at all phases of braking, thereby maintaining the accuracy of the shot.

In some embodiments, a cartridge is provided that includes a projectile assembly as described above as well as a primer and gunpowder. A cartridge, also called a round, packages the projectile assembly, gunpowder and primer into a single case precisely made to fit the firing chamber of a rifled firearm. The primer is a small charge of impact-sensitive chemical that may be located at the center of the case head (centerfire ammunition) or at its rim (rimfire ammunition) whether it's a cartridge case sealing a firing chamber in all directions except down the bore and the use of expanding gases from the burning powder expanding the case to seal against the chamber wall, resulting in the projectile assembly being pushed in the direction least resistance (down the barrel). Electrically-fired cartridges may also be provided. In addition, to the above mentioned configurations, embodiments of the projectile assembly described herein can also be used in cartridgeless system such as a stacked barrel formats or alternative propulsion formats (e.g., rail guns, compressed air guns, spring-based guns, electromagnetic-based guns, paintball guns, and the like).

It is another aspect of the present disclosure to provide a suppressor that is configured to allow the projectile described herein to pass therethrough while maintaining a guided radial restraint of the projectile portions in their interlocked relationship. Traditional suppressors are designed to have a bore area larger than the bore area of the barrel to which they are connected. The idea behind suppressors is that the additional area provided by the suppressor enables the gases which are propelling the projectile to expand within the suppressor rather than outside of the barrel, thereby minimizing the amount of noise associated with the projectile leaving the firearm. Unfortunately, currently available suppressors are incompatible with the projectile assembly of the present disclosure because the projectile portions are allowed to begin expanding apart within the suppressor. Accordingly, the suppressor described herein has raised a railing system (like a traditional rifling track) that has separated support legs that allow expanding gasses to permeate. To promote equalization of pressure in each of the chambers of the unit, the suspended rail guides the projectile assembly through the suppressor and maintains an adequate amount of radial restraint force on the projectile portions, thereby restricting their relative expansion as they pass through it. The rail system further allows for the desired expansion of gasses to reduce the noise signature of the shot. Further, the rail system need only match the twist rate of the rifling of the gun it is to be paired with. This matching assures the backward compatibility with traditional mono-projectiles (slugs) as well as full compatibility with multi-portion projectile assemblies of the proposed disclosure. This allows for the sequentional firing of multi-portion projectile assembly rounds and traditional rounds in the same salvo.

In some embodiments, a projectile assembly for use with a rifled barrel is provided, the projectile assembly generally comprising:

at least a first projectile portion;

at least a second projectile portion; and a tether connecting the first and second projectile portions such that a spinning force imparted on the at least a first and second projectile portions causes the at least a first and second projectile portions to radially expand away from one another up to an expansion limit defined by the tether.

In one further aspect, the at least a first and second projectile portions comprise one or more corresponding locking features which limit relative movement of the at least a first and second projectiles in at least two directions of motion and the locking feature may include a stair-step feature.

In one further aspect, the projectile assembly includes at least a third projectile portion, wherein the tether further connects the at least a third projectile portion to the at least a first and second projectile portions. The projectile assembly may further include at least a fourth projectile portion, wherein the tether further connects the at least a fourth projection portion to the at least a first, second, and third projectile portions.

In some embodiments, the at least a first and second projections portions, when interconnected, are responsive to barrel riffling.

In some embodiments, the tether comprises at least a first and second arm, wherein the at least a first arm connects to the at least a first projectile, and wherein the at least a second arm connects to the at least a second projectile.

In some embodiments, the at least a first projectile portion comprises a via through which the tether passes. This via may correspond to a choke point, wherein the tether comprises a stopper, and wherein the stopper is larger than the choke point. It may also be the case that the choke point is separated from a center of mass of the at least a first projectile portion such that when a force is imparted on the at least a first projectile portion by the tether, the at least a first projectile portion rotates independently.

In some embodiments, the tether may have a chain-stitch configuration where successive loops are pulled through one another and the points where the tether intersects itself may be temporarily bonded with a breakable adhesive.

In some embodiments, the tether may include a loop configuration and the points where the tether intersects itself may be temporarily bonded with a breakable adhesive.

In some embodiments, the projectile assembly may include a cavity into which the tether is inserted while the at least a first and second projectile portions are interconnected to one another. This tether may be spooled in the cavity or folded in the cavity about one or more sleeves. The spooling and/or folding of the tether helps to inhibit the tether getting knotted or stuck as the projectile portions expand away from their original center of rotation.

In some embodiments, the tether is part of a radial braking and tether restraint system which includes a plurality of braking applicators configured to sequentially apply a first set of braking forces to the at least a first and second projectile portions after the at least a first and second projectile portions have expanded a first predetermined distance away from one another.

It is another aspect of the present disclosure to provide a multi-component projectile for use with a rifled barrel, the multi-component projectile comprising:

a first projectile portion;

a second projectile portion; and a tether configured to apply a plurality of braking forces to the first and second projectile portions as the first and second projectile portions expand away from one another as well as their original center of rotation (corresponding to a trajectory path of the multi-component projectile).

In some embodiments, the first projectile portion and second projectile portion are symmetrically constructed.

In some embodiments, the first and second projectile portions are configured to interconnect with one another within a barrel and expand away from one another and a shared center of rotation upon exiting the barrel due to centrifugal forces exerted on the first and second projectile portions under influence of their spinning about a trajectory path that coincides with the shared center of rotation.

In some embodiments, the tether is configured to limit a distance to which the first and second projectile portions are allowed to expand away from their center of rotation. The tether may be part of a tether/braking system which includes a first tether arm for interfacing with the first projectile portion and a second tether arm for interfacing with the second projectile portion. In some embodiments, the first and second tether arms comprise a first and second section, wherein the second sections of the first and second arms comprise a plurality of braking applicators which apply a first set of the plurality of braking forces. The tether/braking system may further include a deformation brake which connects the first and second tether arms, wherein the deformation brake is configured to apply a second braking force. In some embodiments, the application of the second braking force causes the first and second projectile portions to achieve a stable orbit about a trajectory path of the multi-component projectile.

In some embodiments, the first projectile portion comprises a top portion and a bottom portion, the second projectile portion comprises a top portion and a bottom portion, the top portion and bottom portion of the first projectile portion are offset a predetermined amount to create a first offset surface, the top portion and bottom portion of the second projection portion are offset the predetermined amount to create a second offset surface, and the first and second offset surfaces interface to create a locking feature.

In some embodiments, the multi-component projectile further includes a cap which secures the tether/braking system within a cavity of the multi-component projectile when the first and second projectile portions are interconnected with one another.

In some embodiments, the first projectile portion includes a first via through which the tether applies the plurality of braking forces and the second projectile portion includes a second via through which the tether applies the plurality of braking forces.

In some embodiments, the plurality of braking forces are applied to the first projectile portion, at least in part, by the weight of the second projectile portion and the plurality of braking forces are applied to the second projectile portion, at least in part, by the weight of the first projectile portion.

In some embodiments, a multi-staged radial braking and tether restraint system is provided that generally comprises:

at least a first stage adapted to apply at least a first braking force to a plurality of projectile portions when the plurality of projectile portions expand away from their original center of rotation; and at least a second stage adapted to apply at least a second braking force to the plurality of projectile portions when the plurality of projectile portions expand away from their center of rotation.

In some embodiments, the at least a first stage comprises a tether which applies the first braking force when the tether is under tension, the at least a second stage comprises a plurality of braking applicators established on the tether as well as a deformation brake.

In some embodiments the tether is looped and laid back onto itself and the braking applicators comprise a breakable bond created at points of contact where the tether touches itself.

In some embodiments, the tether is configured in such a way that consecutive loops are pulled through one after another (chain-stitched) and the braking applicators comprise a breakable bond created along points of contact where the tether touches itself.

In some embodiments, the tether is spooled and the braking applicators comprise a continuous or semi-continuous breakable bond created along points of contact where the tether touches itself.

It is another aspect of the present disclosure to provide a die-cast mold configured to create the projectile portion or multiples of the projectile portion described herein.

In some embodiments, an ammunition cartridge is provided which generally comprises:

a casing; and a projectile assembly, the projectile assembly including a first and second projectile portion and a tether/braking system connecting the first and second projectile portions, wherein the projectile assembly is configured to be fired from the casing and be responsive to barrel rifling.

In some embodiments, the projectile assembly is responsive to barrel rifling by spinning at it travels down a barrel of a gun.

In some embodiments, a tether of the tether/braking system is further configured to equally apply one or more braking forces to the first and second projectiles thereby limiting an amount to which the first and second projectile portions are allowed to expand away from one another.

In some embodiments, a tether adapted for use with a projectile assembly is provided, the tether generally comprising:

a plurality of braking applicators adapted to sequentially apply a plurality of braking forces to a projectile portion as the tether comes under tension.

In some embodiments, the tether is part of a tether/braking system that further includes a deformation brake. In some embodiments, at least some of the plurality of braking applicators comprise an adhesive securing overlapping portions of the tether.

In some embodiments, a method of manufacturing a multi-component projectile is provided, the method generally comprising:

providing a plurality of projectile portions;

providing a tether/braking system having a tether arm for each of the plurality of projectile portions;

establishing a connection between each tether arm and a corresponding projectile portion;

interlocking the plurality of projectile portions such that a cavity is created between the plurality of interlocked projectile portions; and packing the tether/braking system into the cavity.

In some embodiments, the method of manufacturing further comprises chain-stitching at least a section of each tether arm.

In some embodiments, the method of manufacturing further comprises die casting the plurality of projectile portions.

In some embodiments, the method of manufacturing further comprises inserting the interlocked plurality of projectile portions into a casing.

The Summary is neither intended or should it be construed as being representative of the full extent and scope of the present disclosure. The present disclosure is set forth in various levels of detail and the Summary as well as in the attached drawings and in the detailed description and no limitation as to the scope of the present disclosure is intended by either the inclusion or non inclusion of elements, components, etc. in the Summary. Additional aspects of the present disclosure will become more readily apparent from the detailed description, particularly when taken together with the drawings.

BRIEF DESCRIPTION OF THE DRAWINGS

The present disclosure is described in conjunction with the appended figures.

DETAILED DESCRIPTION

The ensuing description provides embodiments only, and is not intended to limit the scope, applicability, or configuration of the claims. Rather, the ensuing description will provide those skilled in the art with an enabling description for implementing the described embodiments. It being understood that various changes may be made in the function and arrangement of elements without departing from the spirit and scope of the appended claims.

Although certain embodiments of the present disclosure will discuss utilizing propulsion from a gunpowder filled cartridge and projectile assembly, it is equally designed to function with firearms which employ alternative propulsion mechanisms such as, for example, compressed air, electromagnetic propulsion, spring forces, barrel stacked cartridgeless electronic ignition, etc. Although certain embodiments of the present disclosure will discuss utilizing a hand-held rifled firearm, it should be appreciated that embodiments of the present disclosure are not so limited. More specifically, the cartridges, projectiles, projectile assemblies, and components thereof may be used in connection with any type of rifled firearm including small caliber weapons, small arms weapons, combat rifles, heavy weapons, and any other type of firearm configured to impart spinning forces on a projectile.

Figure 1:
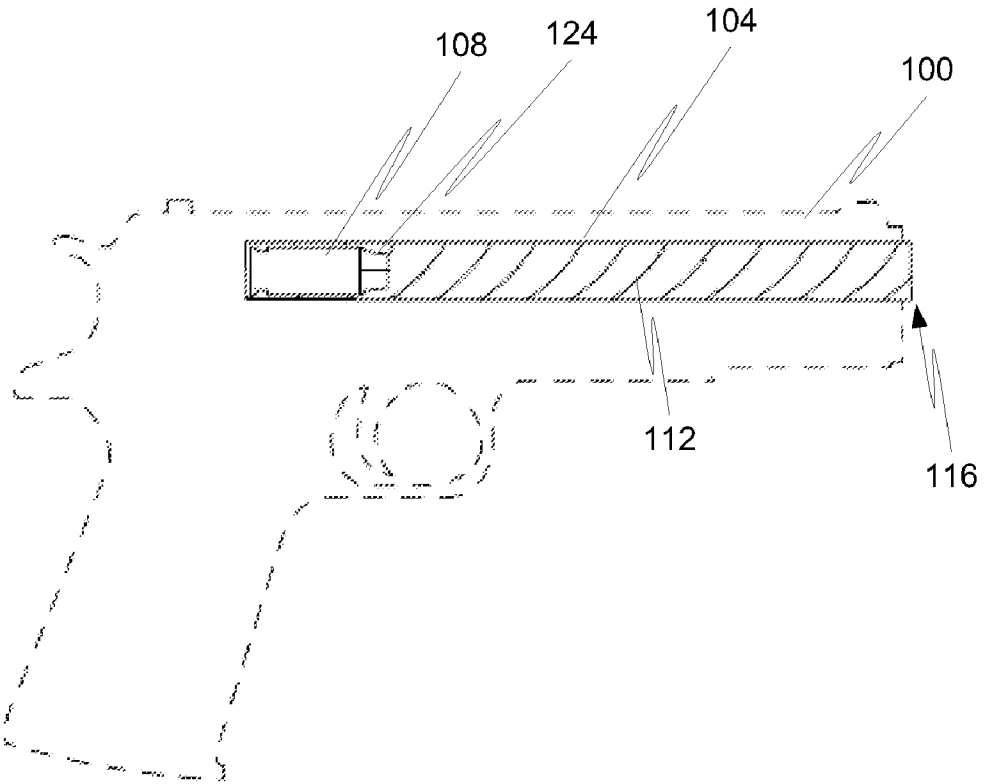
FIG. 1 is a side-schematic view of a rifled firearm and a cartridge within its barrel before the cartridge is fired in accordance with embodiments of the present disclosure.
Figure 2:
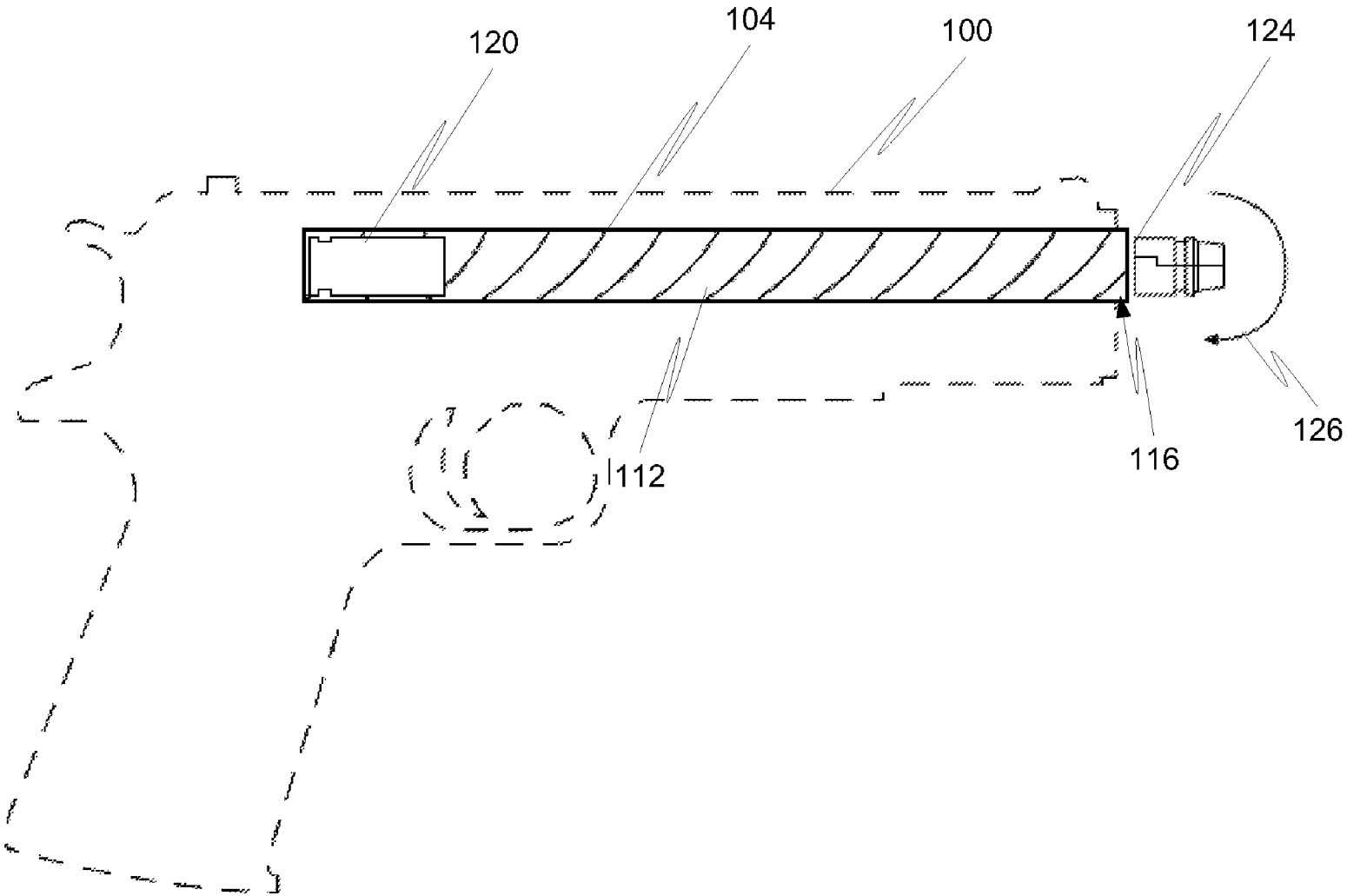
FIG. 2 is a side-schematic view of a projectile assembly immediately after it has exited the barrel of a rifled firearm in accordance with embodiments of the present disclosure.

In some embodiments, the cartridge 108 described herein may be configured for any type of firearm 100 including revolvers, semi-automatic firearms, fully-automatic firearms, handheld firearms, long-barrel rifles, alternatives to rifled firearms, and the like. The semi-automatic handheld firearm 100 depicted in FIGS. 1 and 2 is provided as but one non-limiting example of a firearm 100 which may be used to fire the cartridge 108 discussed herein. As can be appreciated, however, certain characteristics of the cartridge 108 and its components may be altered to accommodate different types of firerams 100. For example, the type of material used for the tether/restraint system and/or projectile portions may vary depending upon the type of firearm 100 used, the spin rate of the firearm 100 used, the muzzle velocity of the firearm 100 used, the desired impact of the projectile, and the like.

FIG. 1 shows a rifled firearm 100 and a cartridge 108 within its barrel 104 before the cartridge 108 is fired in accordance with embodiments of the present disclosure. In this particular state, the cartridge 108 is ready for firing but has not yet been fired and a projectile assembly 124 is positioned within the cartridge 108. In particular, a primer or similar triggering mechanism within the cartridge 108 may not yet have been contacted by a firing pin of the firearm 100. Since the primer has not yet been contacted by a firing pin of the firearm 100, gunpowder within the cartridge 108 has not yet been ignited and the projectile assembly 124 has not yet been separated from a casing 120 of the cartridge 108.

FIG. 2 depicts a projectile assembly 124 of the cartridge 108 after the cartridge 108 has been fired. Upon impacting the primer of the cartridge 108, the gunpowder of the cartridge 108 is ignited and gases begin to expand between a casing 120 of the cartridge 108 and the projectile assembly 124 of the cartridge 108. The rapid expansion of the gases due to the ignition of the gunpowder and the resulting expanding gasses force the projectile assembly 124 to travel down the barrel 104 of the firearm 100 since it is the path of least resistance for the gases to escape the chamber of the firearm 100.

As the projectile assembly 124 travels down the barrel 104 of the firearm 100, rifling features 112 within the barrel 104 spin the projectile assembly 124. In some embodiments, the projectile assembly 124 may achieve a rotational speed and muzzle velocity equal to any traditional projectile fired from the firearm 100. As a couple non-limiting examples, the projectile assembly 124 may achieve a peak rotational speed of between 20,000 and 300,000 RPMs, depending upon the twist rate imparted by the rifling features 112 of the firearm 100 and the muzzle velocity of the projectile assembly 124 as it leaves the barrel exit 116. Specifically, twist rate of firearm 100 can be converted to rotational speed of the projectile assembly 124 as it leaves the barrel exit 116 by using the following formula:

$$RPM=(MV)\times(720/TR)$$

Where RPMs are rotations per minute, MV is muzzle velocity, and TR is twist rate. In traditional rifle projectiles, the rotational speed of the projectile does not reduce significantly as the projectile travels its trajectory. Rather, the projectile traditionally goes trans-sonic, and then sub-sonic long before slowing rotation has any detrimental effect on the trajectory path of the projectile. The projectile assembly 124 leaves the barrel exit 116 with substantially the same properties of a traditional rifle mono-projectile. In some types of rifled firearms 100, the projectile assembly 124 may leave the barrel 104 of the firearm 100 spinning one revolution for every 10 inches traveled. Of course, different firearms 100 may be used to achieve different spin rates.

Figure 3B:
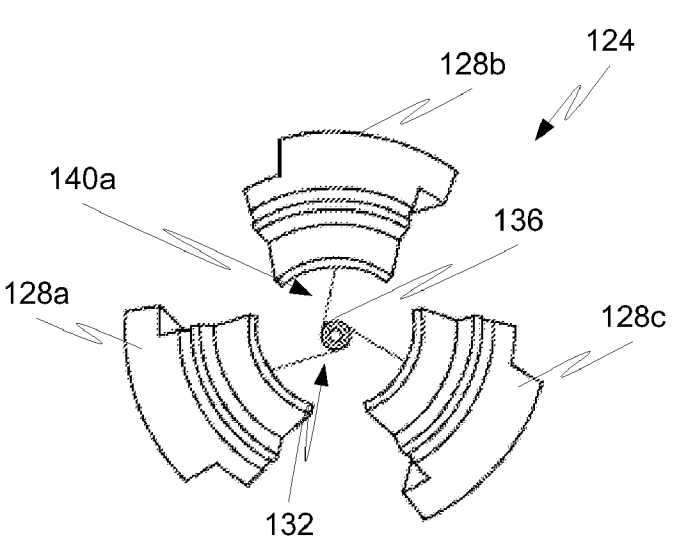
FIG. 3B is a front view of the projectile assembly depicted in FIG. 3A.
Figure 3A:
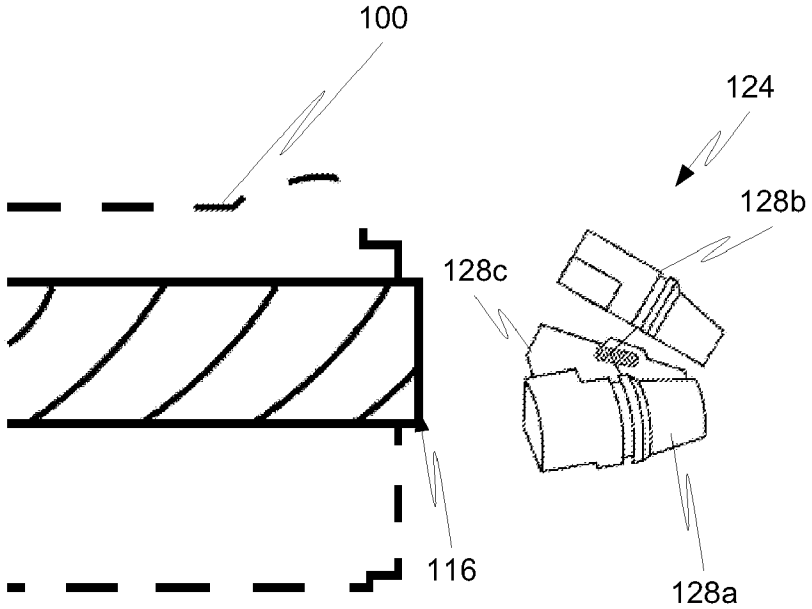
FIG. 3A is a side view of a projectile assembly as it begins to expand to a first spread pattern in accordance with embodiments of the present disclosure.
Figure 4B:
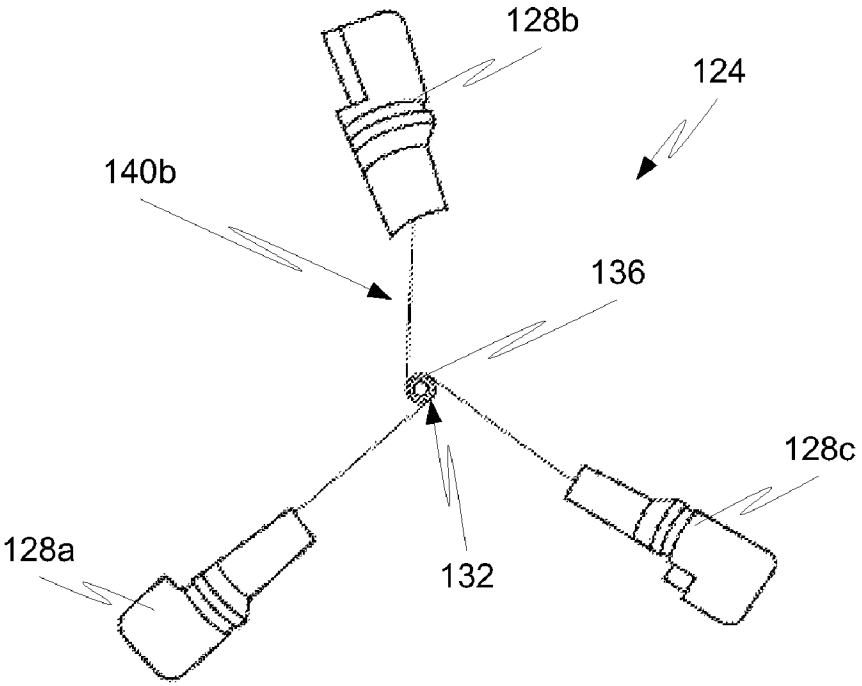
FIG. 4B is a front view of the projectile assembly depicted in FIG. 4A.
Figure 4A:
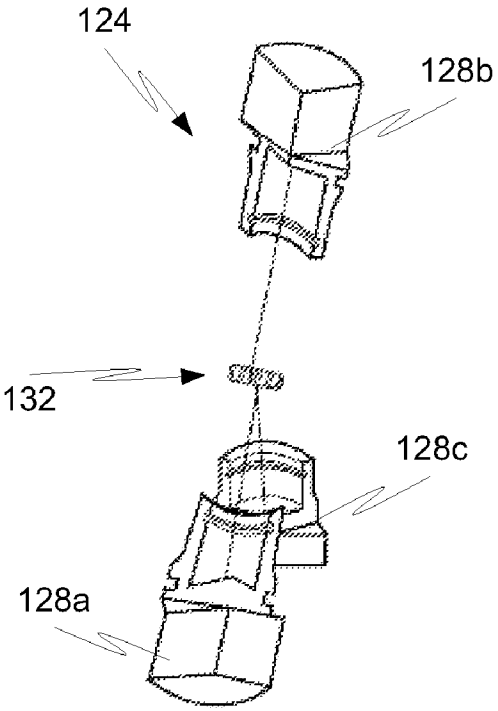
FIG. 4A is a side view of a projectile assembly after it has expanded to a second spread pattern in accordance with embodiments of the present disclosure.
Figure 5B:
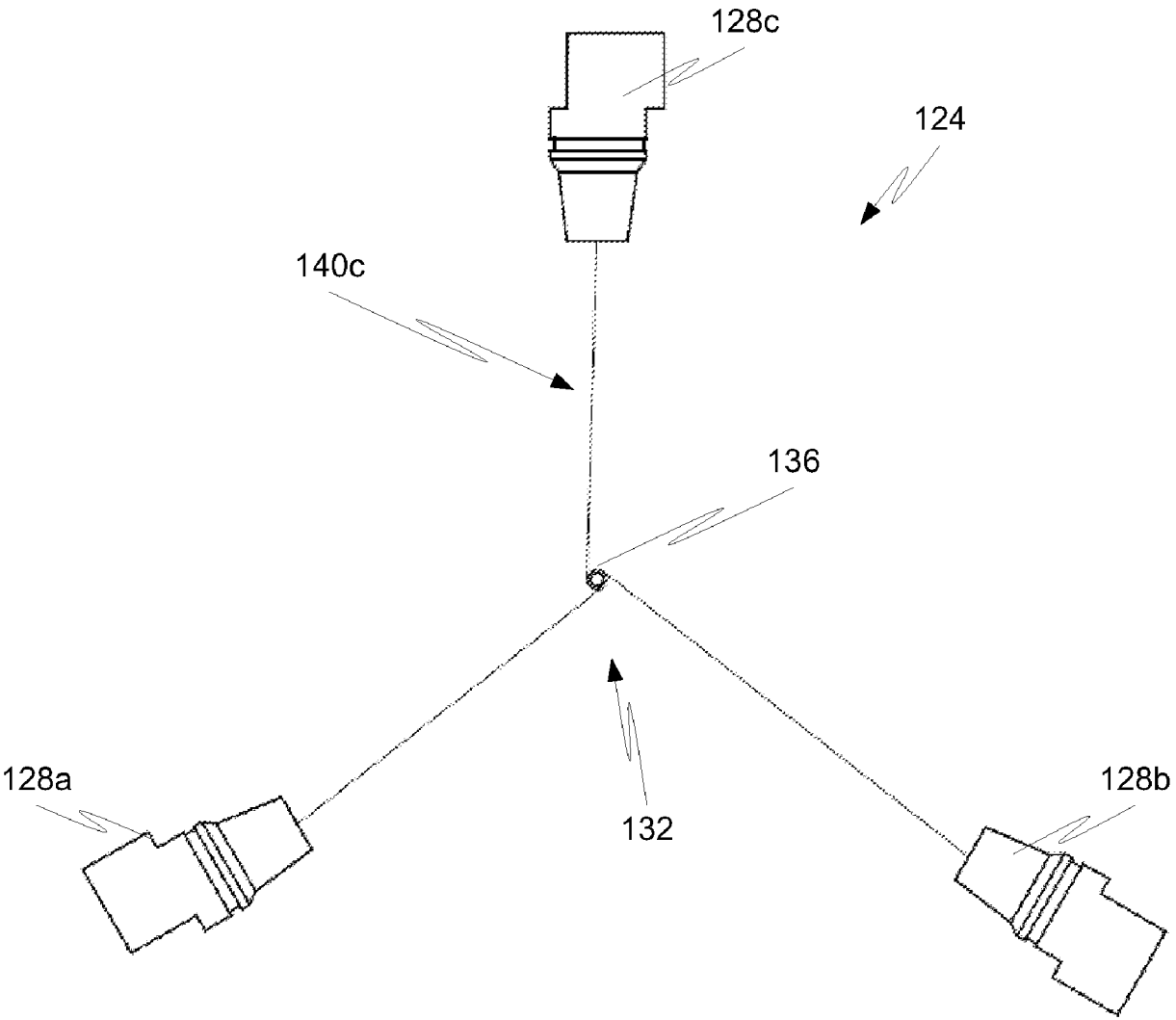
FIG. 5B is a front view of the projectile assembly depicted in FIG. 5A.
Figure 5A:
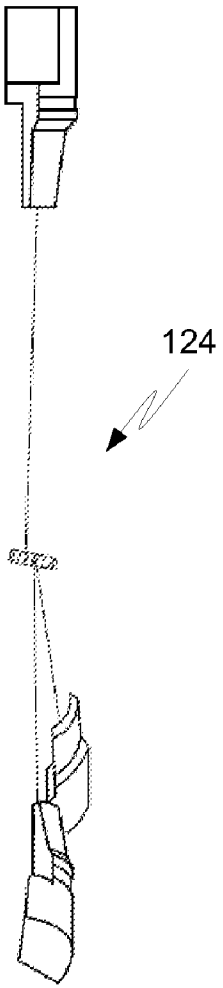
FIG. 5A is a side view of a projectile assembly after it has fully expanded in accordance with embodiments of the present disclosure.

However, as can be seen in FIGS. 3A-B, immediately after the projectile assembly 124 leaves the confines of the barrel 104, the projectile assembly 124 begins to expand radially due to spin-generated forces 126 imparted on the projectile assembly 124, while simultaneously traveling its original trajectory path away from the barrel 104. In some embodiments, the projectile assembly 124 is configured such that the interlocking components in conjunction with the confinement of the walls of the barrel 104 and its rifling 112 do not permit the applicable forces applied to the projectile assembly to alter the relative configuration of the interlock components which make up the projectile assembly 124. However, after the projectile assembly 124 exits the barrel 104 of the firearm 100, there is no longer sufficient confinement or radial restraint force applied, preventing the spin-generated forces 126 from rapidly moving the pre-fragmented projectile segments of assembly 124 out form the original center of rotation 136. In the absence of such radial restraint forces, the spinning of the projectile assembly 124 imparts an outward force on projectile portions 128*a*, 128*b*, 128*c* of the projectile assembly 124. The outwardly-directed forces applied to each projectile portion 128 cause the projectile portions 128*a*, 128*b*, 128*c* to expand away from the center of rotation 136 and one another respectively, thereby increasing a spread pattern of the projectile assembly 124.

In some embodiments, the spin-generated forces 126 provide several functions and features. First, the spin-generated forces enable the projectile assembly 124 and all its constituent parts to remain gyroscopically stabilized, which means the projectile assembly 124 maintains its original trajectory path and is as accurate as a conventional mono-projectile that spins. Second, the spin-generated forces cause an accelerated radial expansion of the projectile assembly 124. More specifically, the projectile portions 128*a*, 128*b*, 128*c* are configured to expand away from their center of rotation 136 up to four times faster than the rate at which conventional buckshot expands. Third, the spin-generated forces 126 enables the projectile assembly 124 to achieve a spread pattern that is larger in area than the barrel 104 of the gun 100 from which it was fired.

In some embodiments, the projectile assembly 124 includes a first projectile portion 128, a second projectile portion 128*b*, and a third projectile portion 128*c* which are interconnected to one another via a tether/braking system 132. While the projectile portions 128*a*, 128*b*, 128*c* are allowed to expand away from the center of rotation 136 and one another respectively as the projectile assembly 124 travels down range, due to the conservation of angular momentum, the original center of rotation 136 of the projectile assembly 124 will travel along a trajectory path that is substantially identical to the path/trajectory as if the projectile fired remained a solid slug. Accordingly, with only a minor adjustment for increased drag, the projectile assembly 124 is not only configured to achieve a substantially larger strike area, the range and accuracy of the firearm is substantially uninhibited in doing so.

Initially, the projectile portions 128*a*, 128*b*, 128*c* are allowed to accelerate radially away from center with little to no tether resistance. However, after the projectile portions 128*a*, 128*b*, 128*c* have moved a first predetermined radial distance 140*a* away from the center of rotation 136, the tether (s) of the tether/braking system 132 begin to restrain the projectile portions 128*a*, 128*b*, 128*c*, thereby causing the projectile portions 128*a*, 128*b*, 128*c* to begin a radial deceleration.

As can be seen in FIGS. 4A-B and 5A-B, the projectile assembly 124 continues to rotate and the projectile portions 128*a*, 128*b*, 128*c* continue to expand at a decreasing rate of speed away from the center of rotation 136. The projectile portions 128*a*, 128*b*, 128*c* may move a second predetermined radial distance 140*b* away from the center of rotation 136 until the projectile assembly 124 achieves full deployment and the projectile portions 128*a*, 128*b*, 128*c* are no longer moving radially away from center or one another respectively. In this full deployment, the projectile portions 128*a*, 128*b*, 128*c* may be positioned a third predetermined radial distance 140*c* away from the center of rotation 136 of the projectile assembly 124. Additional details of this process will be described in further detail herein. However, it is useful to note that while the projectile assembly 124 may have originally had a twist rate of one rotation for every 10 inches traveled, after the projectile assembly 124 has achieved its stable orbit, the laws of conversation of angular momentum dictate that the projectile assembly 124 may only have a twist rate of one rotation for every 800 feet traveled. In particular, the projectile assembly 124 originally had a very small moment arm when it left the barrel 104 of the firearm 100, but after full deployment the moment arm of the projectile assembly 124 due to the expansion of the projectile portions 128*a*, 128*b*, 128*c* significantly decrease the rate at which the expanded projectile assembly rotates.

Another interesting characteristic of the projectile assembly 124 can be seen in FIGS. 3A-*b*, 4A-B, and 5A-B. In particular, the projectile portions 128*a*, 128*b*, 128*c* may shift their leading edge as the projectile assembly 124 travels down range. As can be seen in FIGS. 3A-B, the projectile portions 128*a*, 128*b*, 128*c* may have a first leading edge within the barrel 104 but as the projectile assembly 124 travels down range and the projectile portions 128*a*, 128*b*, 128*c* expand away from center, the projectile portions 128*a*, 128*b*, 128*c* may rotate about their own center of rotation and have a second leading edge that is different from their first leading edge. In some embodiments, the segments are deliberately shaped to use the friction as it travels thru the atmosphere in conjunction with an imbalanced weight distribution to cause the second leading edge to present a forward orientation and correspondingly results in a new leading edge with an optimal aerodynamic profile as it travels down range.

In some embodiments, the individual rotation of each projectile portion 128*a*, 128*b*, 128*c* may be controlled by strategically positioning the location where the tether/braking system 132 interfaces with the projectile portion 128*a*, 128*b*, 128*c*. In some embodiments, the center of mass of the projectile portion 128*a*, 128*b*, 128*c* may be located below (i.e., toward the back) of the location where the tether/braking system 132 interfaces with the projectile portion 128*a*, 128*b*, 128*c*. By separating the tether/braking system 132 interface from the center of mass of the projectile portion 128*a*, 128*b*, 128*c*, the projectile portions 128*a*, 128*b*, 128*c* are individually rotated as the spin-generated forces push the projectile portions 128*a*, 128*b*, 128*c* radially outward and as the tether/braking system 132 begins to restrain the radial expansion of the projectile portions 128*a*, 128*b*, 128*c*.

Although the projectile assembly 124 is depicted as having a first, second, and third projectile portion 128*a*, 128*b*, and 128*c*, respectively, one skilled in the art will appreciate that a projectile assembly 124 may have as few as two and as many as five projectile portions without departing from the scope of the present disclosure. As one example, the projectile assembly 124 may comprise only a first and second projectile portion. As another example, the projectile assembly 124 may comprise a first, second, third, and fourth projectile portion. As another example, the projectile assembly 124 may comprise a first, second, third, fourth and fifth projectile portion.

The types of materials used to construct the projectile portions 128*a*, 128*b*, 128*c* can vary depending upon the type of use envisioned for the projectile assembly 124. For instance, different materials may be used in hunting-type projectile assemblies 124 as compared to self-defense-type projectile assemblies 124. Other types of uses which may control the materials used to construct the projectile portions 128*a*, 128*b*, 128*c* include, without limitation, stunning use cases, knock-down use cases, riot-control use cases, home-defense use cases, and so on. The types of materials that may be used to construct the projectile assembly 124 include, without limitation semi-mailaubal plastics, metals, organic or inorganic rubbers, lead, jacketed lead, zinc, zinc alloys, oxygen free copper and alloys like copper nickel, tellurium copper and brass like highly machinable UNS C36000 Free-Cutting Brass, tungsten, tungsten carbide, steel, Bismuth, rubber, wax, Polyvinyl Chloride (PVC) and other polymers, polycarbonate plastic, other plastics and any combinations thereof.

Similarly, the types of materials used to construct the tether/braking system 132 can vary depending upon the type of use envisioned for the projectile assembly 124. In certain hunting use cases, it may be desirable to utilize a tether material 132 that breaks rather easily upon impact, thereby increasing the penetration depth of each projectile portion 128*a*, 128*b*, 128*c*. In certain home-defense use cases, it may be desirable to utilize a tether material 132 that does not break so easily upon impact, thereby minimizing penetration depth and limiting the projectile assembly's ability to travel through sheet rock and other wall materials. Suitable materials which may be used to construct the projectile assembly 124 include, but are not limited to, a para-aramid synthetic fiber (e.g., generally an aramid fibercotton), woven cotton, silk, flourocarbon and other polymers, steel, and any other pliable thread-like material which can be packaged within the projectile assembly 124 but is also capable of exerting a restraining force on the projectile portions 128*a*, 128*b*, 128*c* until the radial outward force is arrested and a desired spread pattern is obtained.

Figure 6C:
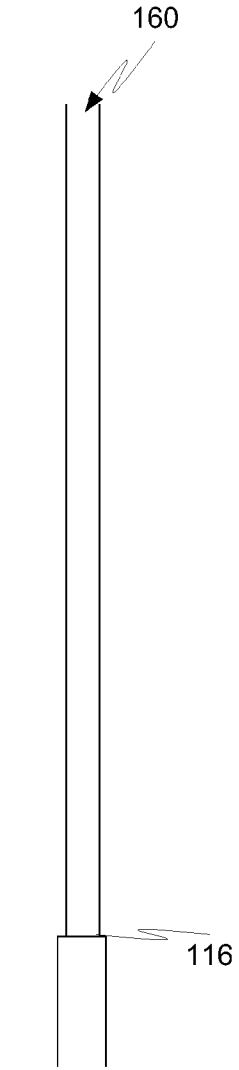
FIG. 6C is a top view of a single projectile spread pattern as a function of distance traveled away from a barrel.
Figure 6B:
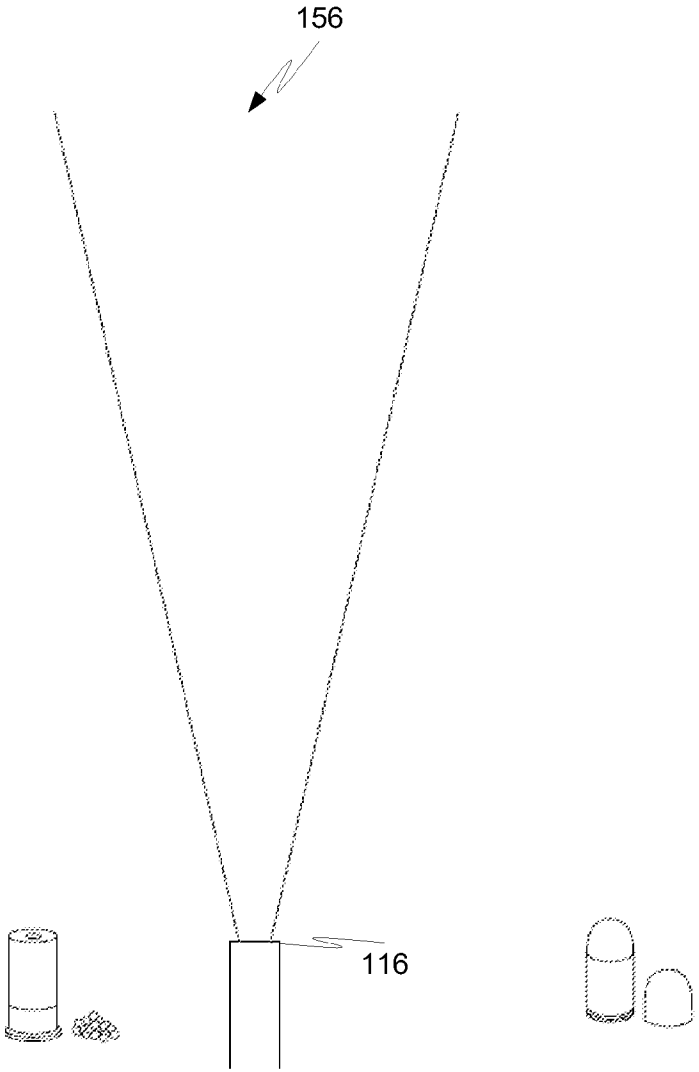
FIG. 6B is a top view of a buckshot spread pattern as a function of distance traveled away from a smooth-bored barrel.
Figure 6A:
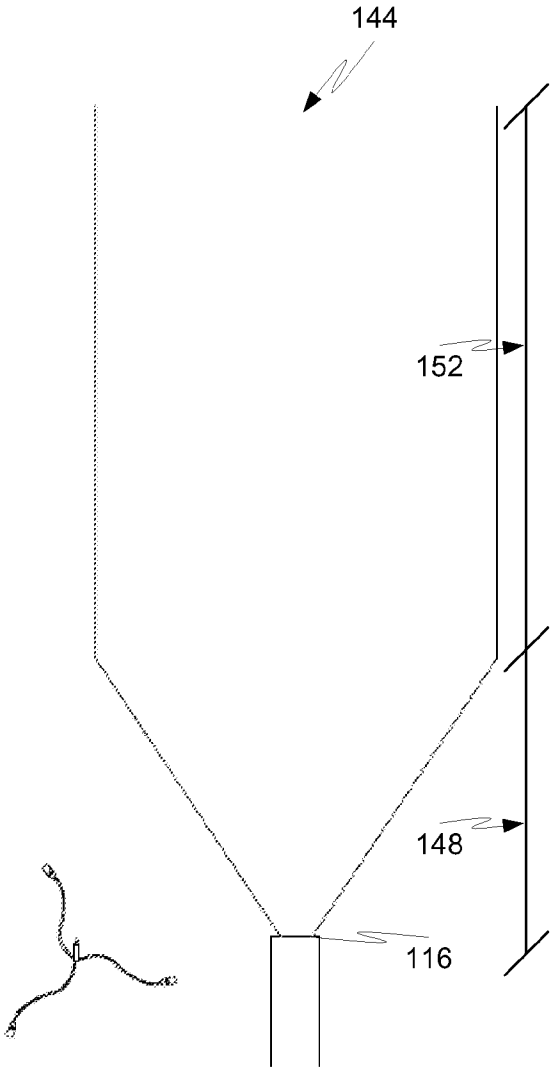
FIG. 6A is a top view of a projectile assembly spread pattern as a function of distance traveled along its trajectory away from a barrel in accordance with embodiments of the present disclosure.

With reference now to FIGS. 6A-C, the spread pattern of a projectile assembly 124 disclosed herein will be compared to the spread patter of shotgun and traditional rifle projectiles. FIG. 6A shows a spread pattern 144 of a projectile assembly 124 in accordance with embodiments of the present disclosure. Upon leaving the barrel exit 116, the projectile assembly 124 is allowed to expand for up to a first predetermined distance 148 down range. After the projectile assembly 124 has traveled the first predetermined distance 148, the projectile assembly 124 is considered fully deployed and is allowed to maintain its fully deployed configuration as it travels a second distance 152 beyond the first predetermined distance 148. The projectile assembly 124 maintains this configuration until it reaches and strikes its target or until the projectile assembly 124 falls to the ground. In contrast, the mono-projectile creates a uniform area of influence (surface area available for contact as measured form the center of rotation) regardless of distance from the tip of the gun. Further, in comparison the ever expanding profile 156 of un-tethered multi-projectile shot (scattershot) used a slow but ever expanding rate of expansion to increase the area of influence (surface area available for contact as measured form the center of rotation) to in turn increase the hit probability.

In some embodiments, the center of rotation 136 of the projectile assembly 124 maintains its original trajectory. Although the increased drag of a full deployed projectile assembly 124 may decrease the down range velocity at a quicker pace than that of a traditional slug, the projectile assembly 124 can cover the same distance, with a minor adjustment of trajectory. However, within a range of 50 yards or less, the trajectory is nearly identical to the trajectory followed by a single projectile fired from the same firearm and any difference is compensated for by the increased area of influence of the orbiting portions 128*a*, 128*b*, 128*c*.

Figure 10:
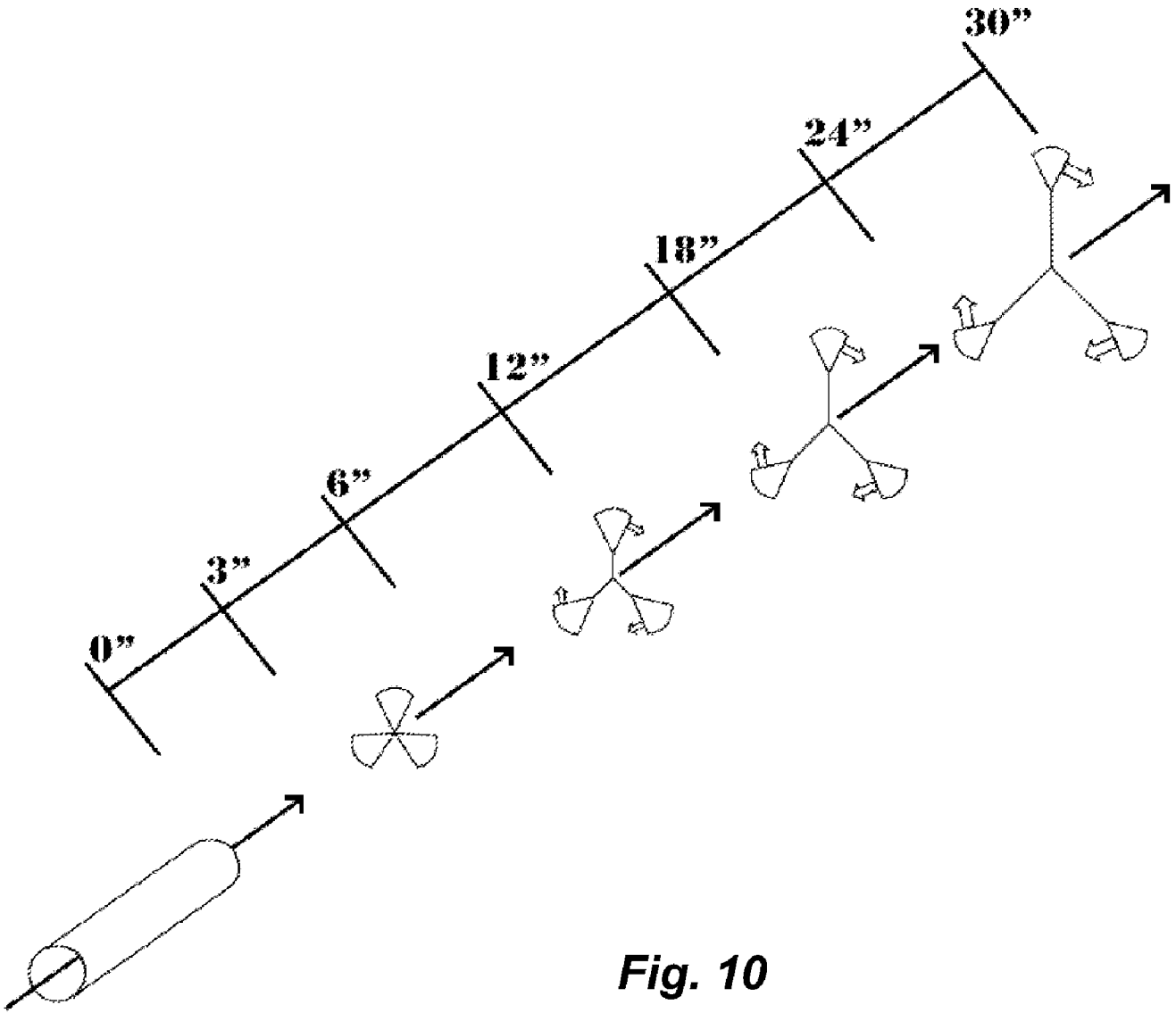
FIG. 10 is a perspective view of a shot profile of a three-portion projectile assembly as a function of distance traveled from a barrel.

The projectile assembly 124 provides many advantages over the prior art. Once such advantage is that, as compared to a shotgun spread pattern 156, the projectile assembly 124, by harnessing the spin-generated force, expands at a faster rate (i.e., achieves a larger effective strike area) than multiple projectiles fired from a standard shotgun. As one example, projectile assembly 124 test firing has achieved twelve inches of spread by the time the assembly 124 had traveled eight feet away from the barrel exit 116. This particular feature can be seen more clearly with respect to FIG. 10.

In comparison, a typical shotgun firing buckshot requires approximately 32 feet before a spread of 12 inches in diameter is obtained. Another advantage is that, as compared to the shotgun spread pattern 156, the expansion of the projectile assembly 124 is limited after the projectile assembly 124 has traveled the first predetermined distance 148. The un-tethered multiple projectiles fired from a shotgun, on the other hand, continue to spread apart from one another without restriction. This decreases the shotgun's effectiveness at greater distances due to the fact that large gaps form between the projectile portions. Yet another advantage is that, as compared to the spread pattern of a single projectile 160, the projectile assembly 124 is able to achieve a spread pattern that is larger than an area of the rifle barrel 104, thereby increasing the potential strike area and the chances of a successful strike at both short and long ranges due to the finite amount of spread. The single projectile 160 only has a spread pattern prior to impact equal to the size of the rifle barrel 104.

Figure 7A:
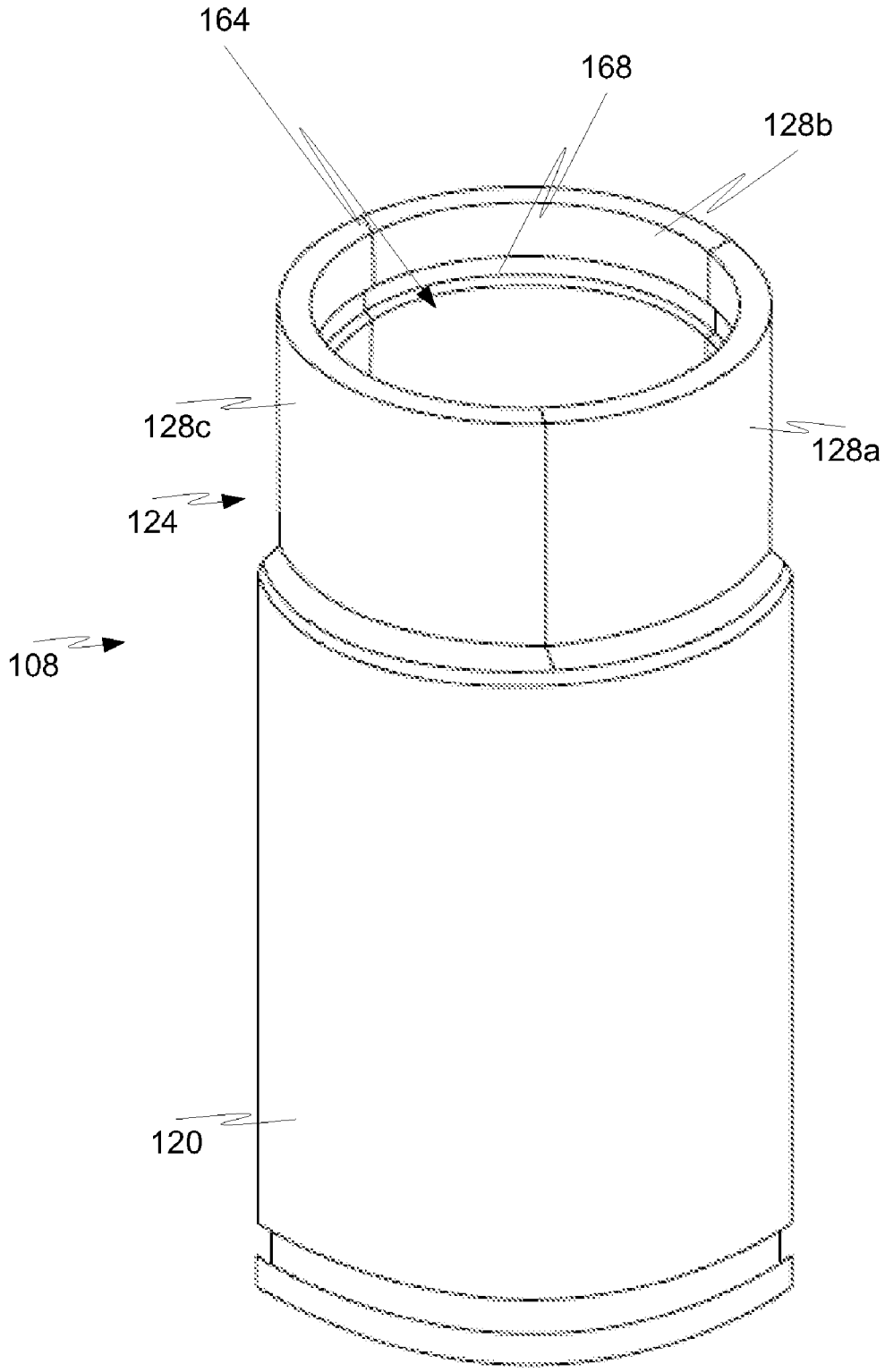
FIG. 7A is a perspective view of a cartridge having a three-portion projectile assembly in accordance with embodiments of the present disclosure.

Referring now to FIG. 7, additional details of a cartridge 108 will be described in accordance with at least some embodiments of the present disclosure. The cartridge 108 may package a primer (not shown), gunpowder (not shown), and the projectile assembly 124 within a casing 120. When the projectile portions 128*a*, 128*b*, 128*c* of the projectile assembly 124 are within the casing 120, the projectile portions 128*a*, 128*b*, 128*c* are considered to be interlocked to one another. In particular, the projectile portions 128*a*, 128*b*, 128*c* may be configured similarly to a traditional rifle projectile so as to limit the amount of gas which escapes past the projectile assembly 124 and out the barrel 104. In some embodiments, the only type of force which may cause the projectile portions 128*a*, 128*b*, 128*c* to become unlocked from their in-casing configuration is a net force directed radially outward from the center of rotation 136 of the projectile assembly 124. The casing 120 and barrel 104 always supply a sufficient amount of containment force directed radially inward such that the projectile assembly 124 is only allowed to expand after it has left the barrel exit 116.

When the projectile portions 128*a*, 128*b*, 128*c* are interconnected with one another and placed in the casing 120, an upper cavity 164 may be created between the projectile portions 128*a*, 128*b*, 128*c*. As will be discussed in further detail herein, the upper cavity 164 is provided as a storage location for the tether/braking system 132 of the projectile assembly 124. A lid may be placed over the top of the upper cavity to fully contain the tether/braking system 132 during shipment. In some embodiments, a lid feature 168 is provided which enables the lid to fit securely within the upper cavity 164 and remain in place until the projectile portions 128*a*, 128*b*, 128*c* begin to expand away from one another. In some embodiments, the lid feature 168 comprises a lip, notch, hook, or similar friction fit-based feature that locks a lid into position over the upper cavity 164. Threading, screws, adhesives, and other types of features may be used to create the lid feature 168 without departing from the scope of the present disclosure.

Figure 7B:
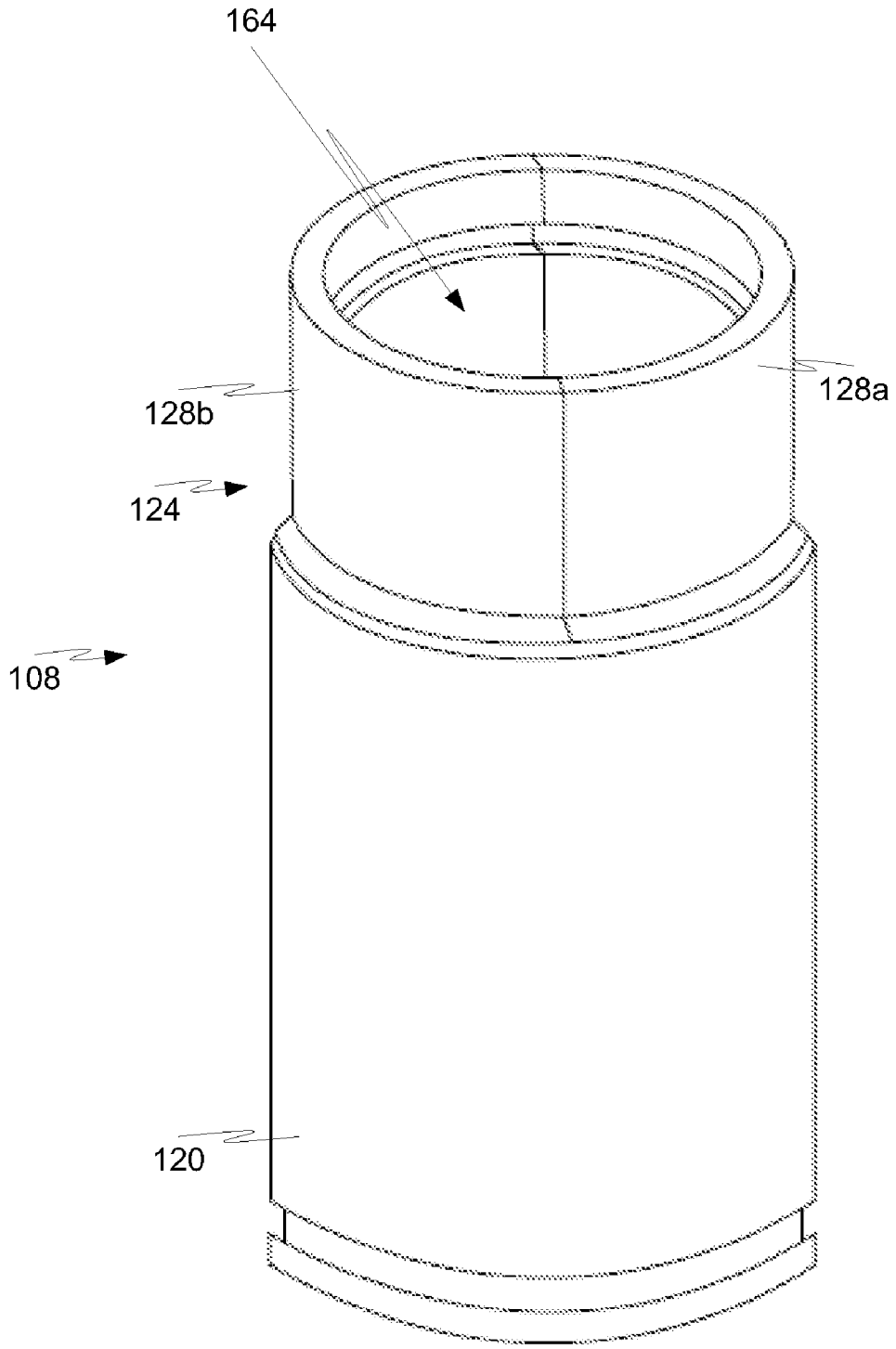
FIG. 7B is a perspective view of a cartridge having a two-portion projectile assembly in accordance with embodiments of the present disclosure.

As can be seen in FIG. 7B, a cartridge 108 may alternatively be provided with a projectile assembly 124 which only includes a first and second projectile portion 128*a* and 128*b*, respectively.

Figures 8A, 8B, 8C, 8D:
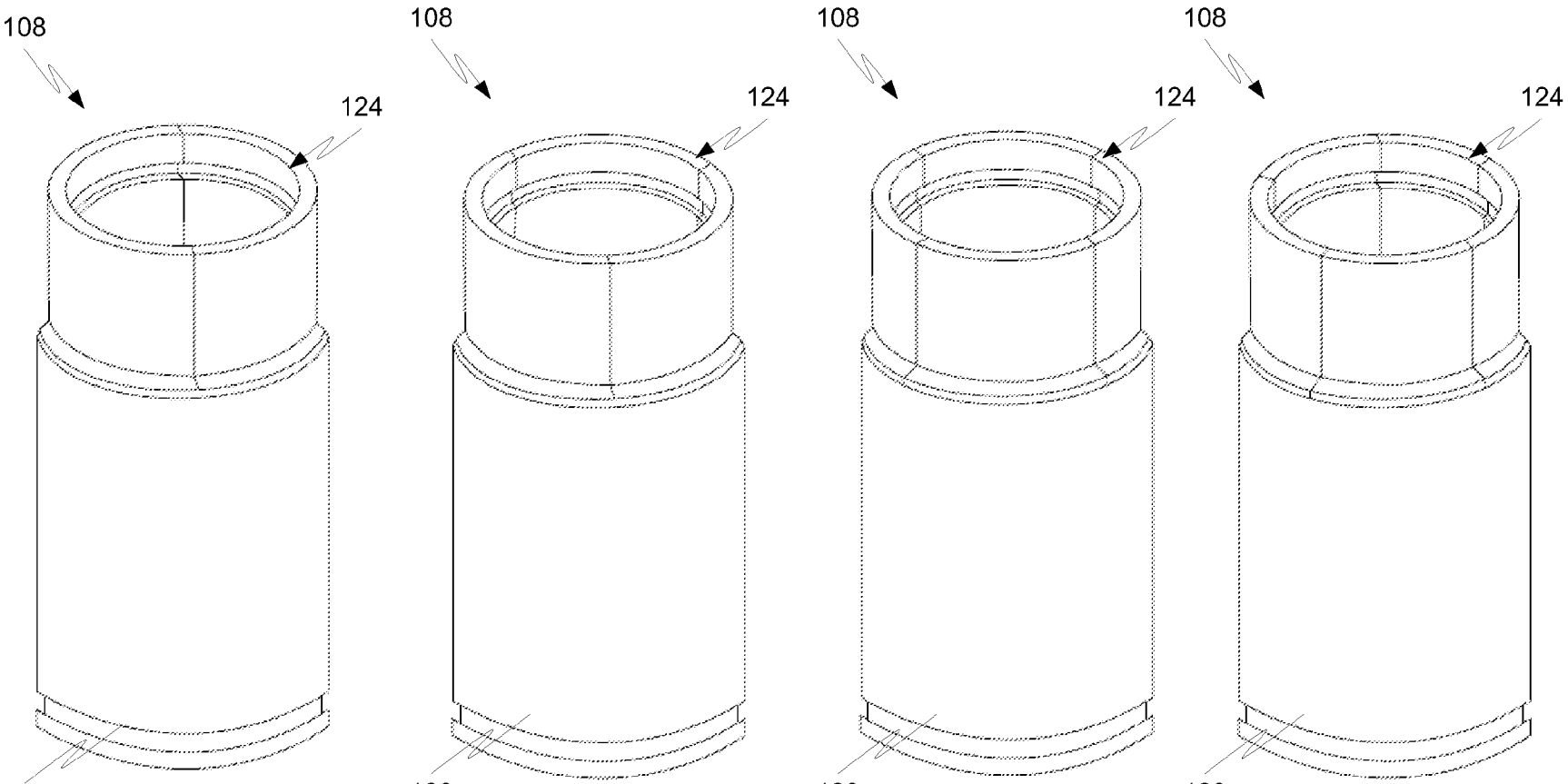
FIG. 8A is another perspective view of a cartridge having a two-portion projectile assembly in accordance with embodiments of the present disclosure.
FIG. 8B is another perspective view of a cartridge having a three-portion projectile assembly in accordance with embodiments of the present disclosure.
FIG. 8C is a perspective view of a cartridge having a four-portion projectile assembly in accordance with embodiments of the present disclosure.
FIG. 8D is a perspective view of a cartridge having a five-portion projectile assembly in accordance with embodiments of the present disclosure.

FIGS. 8A-D depict a cartridge 108 with projectile assemblies 124 of various numbers of projectile portions 128. As can be seen in FIG. 8D, up to five projectile portions may be used to construct the projectile assembly 124.

Figure 9B:
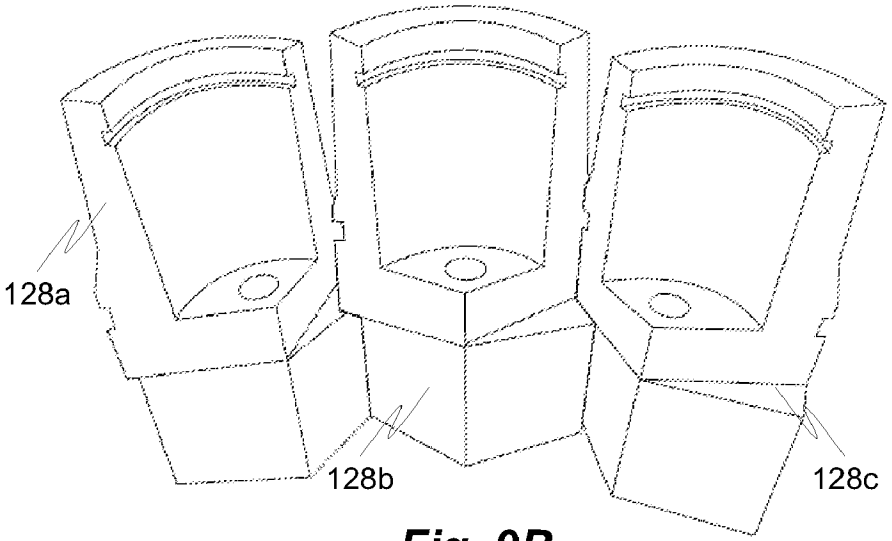
FIG. 9B is a perspective view of a three-portion projectile assembly spread apart and partially interlocked in accordance with embodiments of the present disclosure.
Figure 9A:
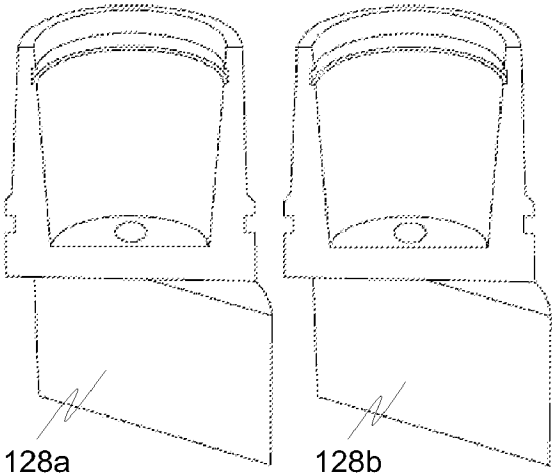
FIG. 9A is a perspective view of a two-portion projectile assembly spread apart in accordance with embodiments of the present disclosure.
Figure 9C:
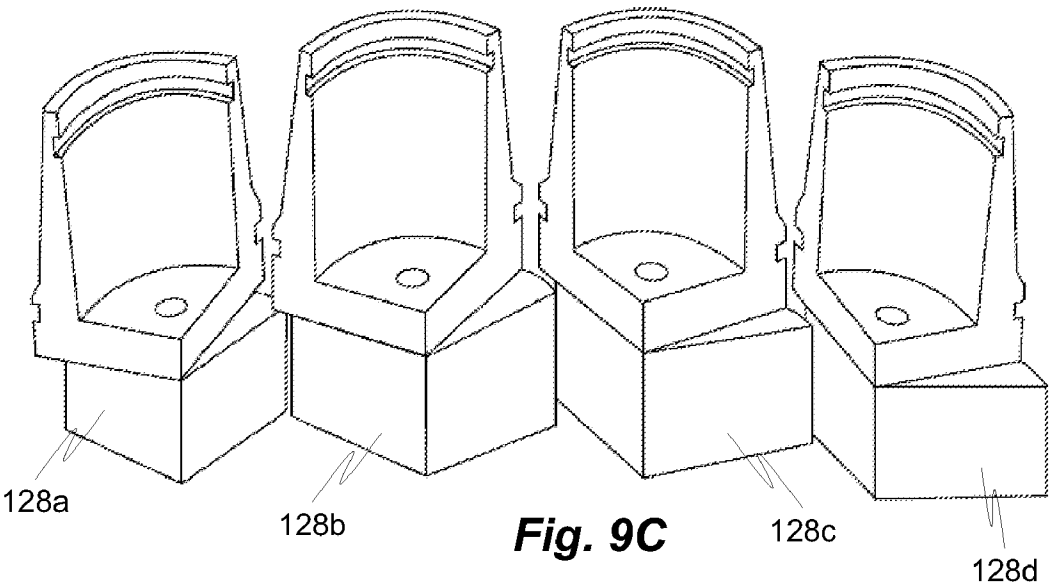
FIG. 9C is a perspective view of a four-portion projectile assembly spread apart and partially interlocked in accordance with embodiments of the present disclosure.

FIG. 9A depicts an example of first and second projectile portions 128*a* and 128*b*, respectively, when the projectile portions are not within a casing 120. FIG. 9B depicts one example of first, second, and third projectile portions 128*a*, 128*b*, and 128*c*, respectively, when the projectile portions are not within a casing 120. FIG. 9C depicts one example of first, second, third, and fourth projectile portions 128*a*, 128*b*, 128*c*, 128*d* respectively, when the projectile portions are not within a casing 120.

Figure 11C:
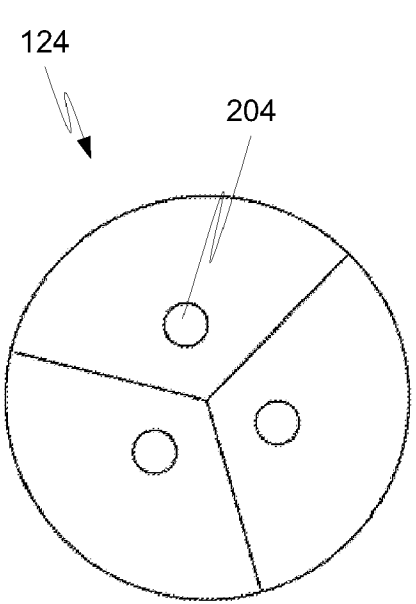
FIG. 11C is a bottom view of the projectile assembly depicted in FIG. 11A.
Figure 11B:
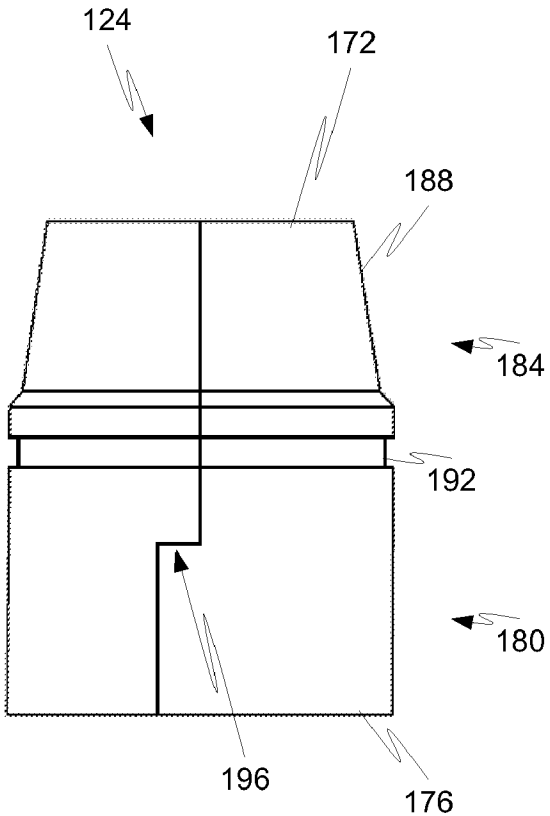
FIG. 11B is a side view of the projectile assembly depicted in FIG. 11A.
Figure 11A:
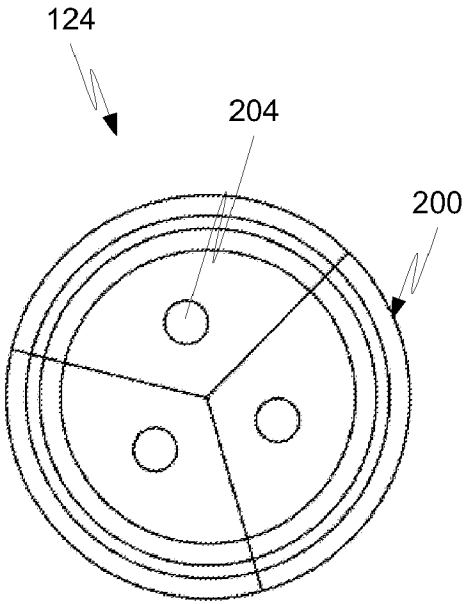
FIG. 11A is a top view of a three-portion projectile assembly in accordance with embodiments of the present disclosure.
Figure 11D:
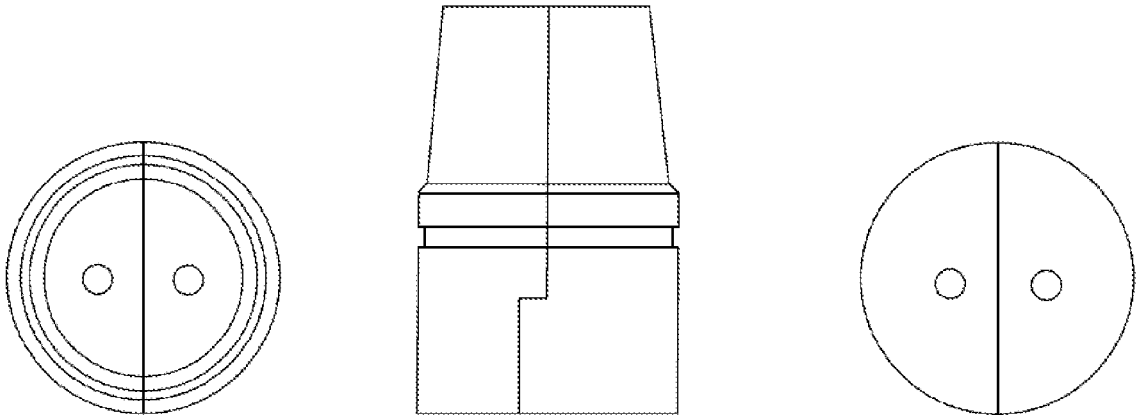
FIG. 11D is a top, side, and bottom view of a two-portion projectile assembly in accordance with embodiments of the present disclosure.
Figure 11E:
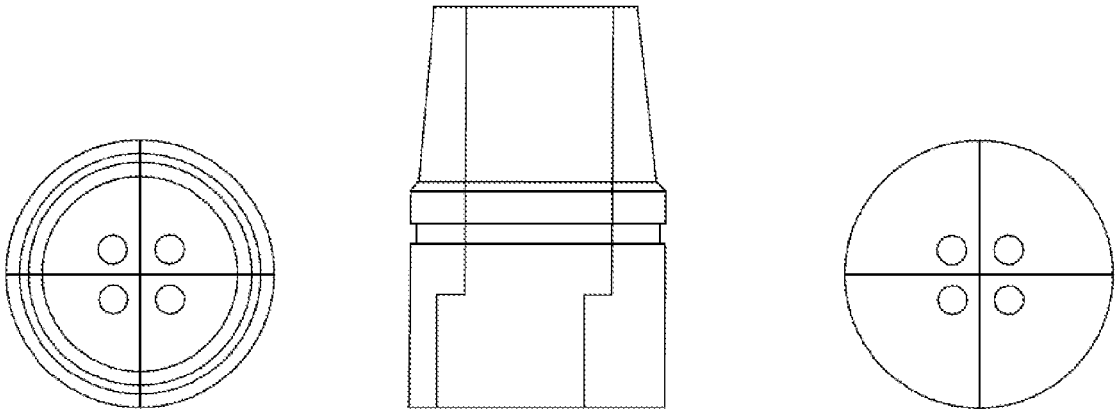
FIG. 11E is a top, side, and bottom view of a four-portion projectile assembly in accordance with embodiments of the present disclosure.
Figure 11F:
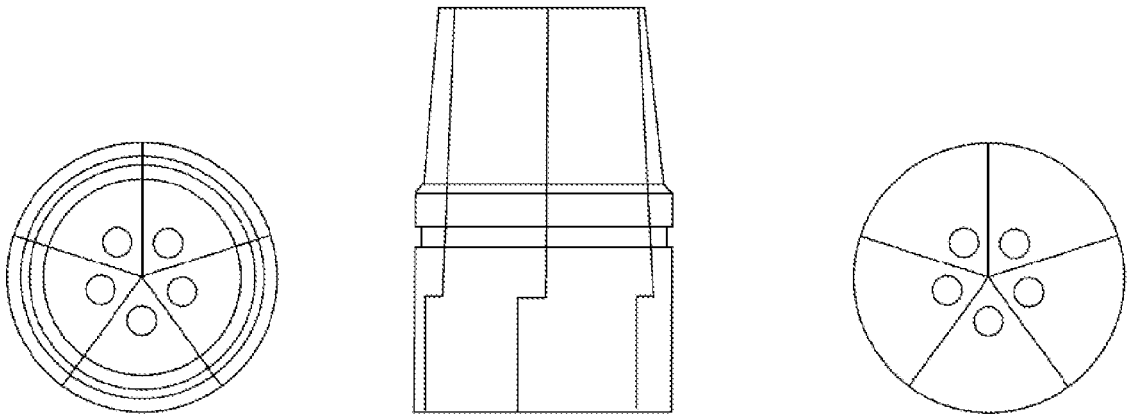
FIG. 11F is a top, side, and bottom view of a five-portion projectile assembly in accordance with embodiments of the present disclosure.
Figure 12:
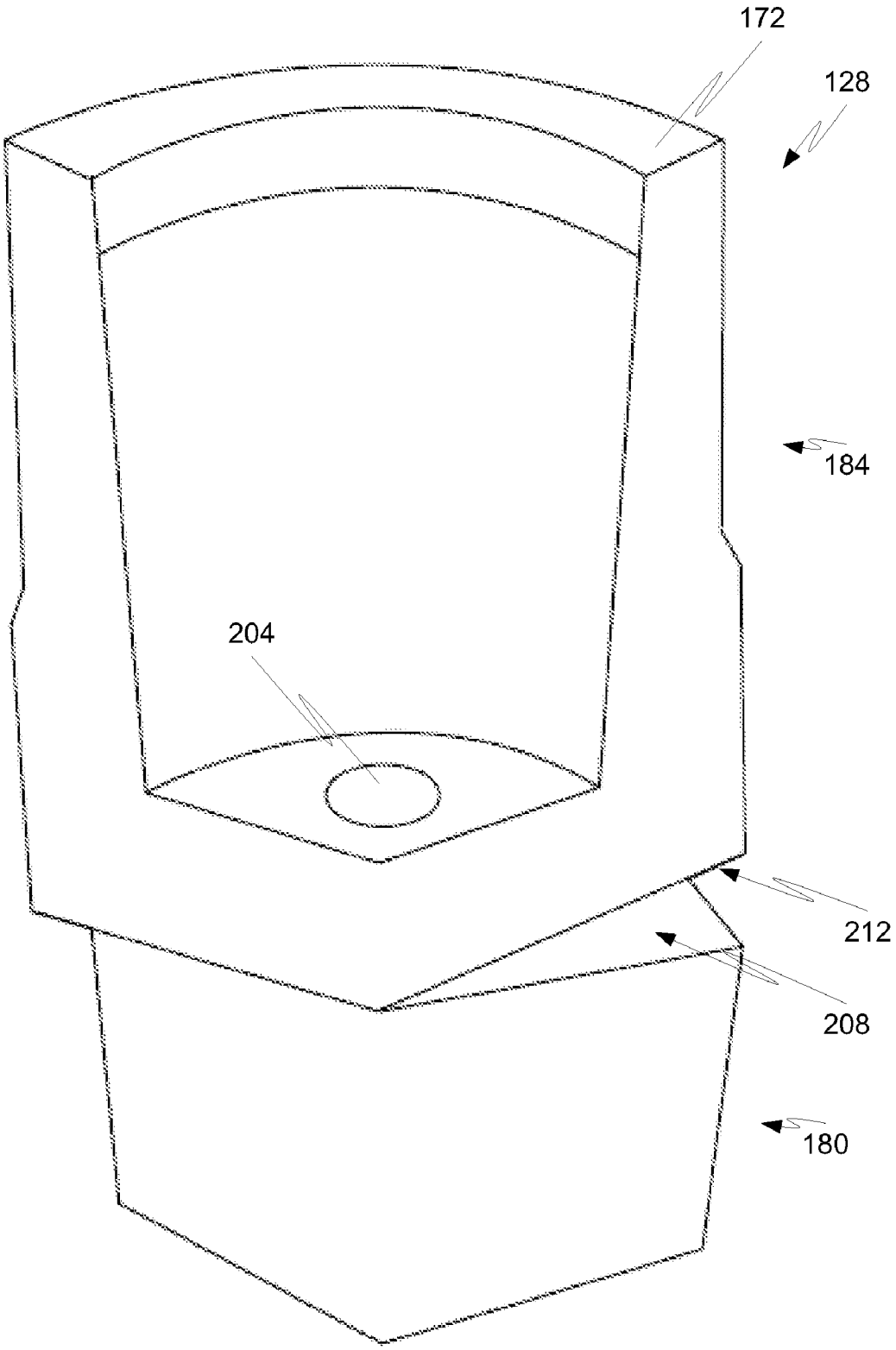
FIG. 12 is a perspective view of a projectile portion in accordance with embodiments of the present disclosure.
Figure 13C:
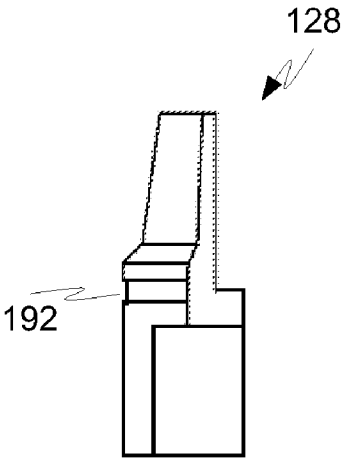
FIG. 13C is a second side view of the projectile portion of FIG. 12.
Figure 13F:
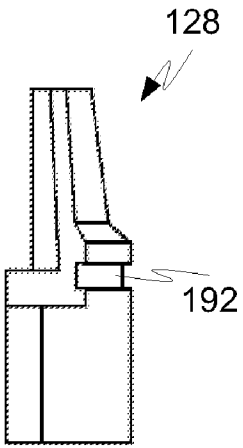
FIG. 13F is a fourth side view of the projectile portion of FIG. 12.
Figure 13B:
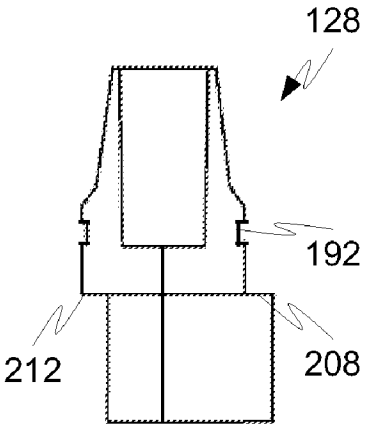
FIG. 13B is a first side view of the projectile portion of FIG. 12.
Figure 13E:
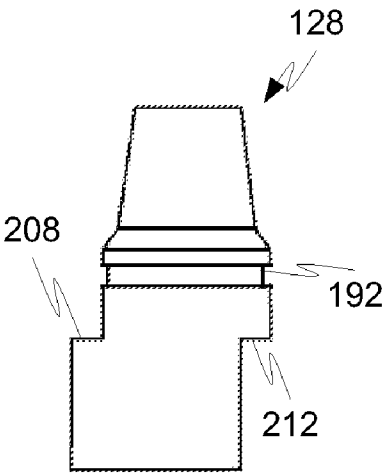
FIG. 13E is a third side view of the projectile portion of FIG. 12.
Figure 13A:
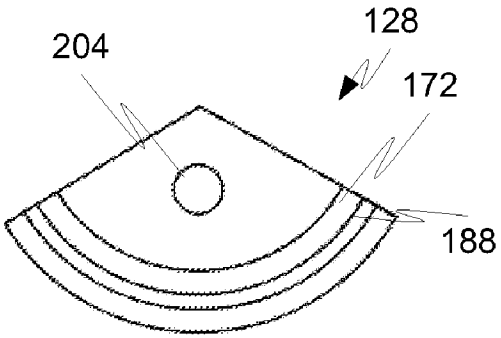
FIG. 13A is a top view of the projectile portion of FIG. 12.
Figure 13D:
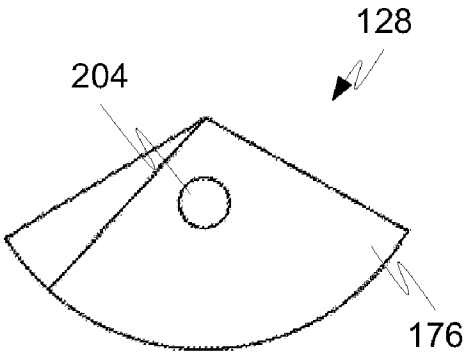
FIG. 13D is a bottom view of the projectile portion of FIG. 12.

FIGS. 11A-C depict further examples of a projectile assembly 124 when the projectile portions 128*a*, 128*b*, 128*c* are interconnected with one another, such as if the projectile assembly 124 were within a casing 120. The projectile assembly 124 may comprise a first leading edge 172, which is the leading edge of the projectile assembly 124 as it travels through a barrel 104. The opposite edge of the projectile assembly 124 may be considered the trailing edge 176 and may be the surface of the projectile assembly 124 which traps gases between the projectile assembly 124, the walls of the barrel 104 and the casing 120.

In some embodiments, the projectile assembly 124 may comprise a bottom portion 180 and a top portion 184. The bottom portion 180 may comprise more weight than the top portion 184, thereby making the center of mass of the projectile assembly 124 reside below its equator. Similarly, the center of mass for each projectile portion 128 may be located below the line which is equidistance from the leading edge 172 and trailing edge 176. In other words, the center of mass of each projectile portion 128 may be in the bottom half of the projectile portion 128.

In some embodiments, the top portion 184 comprises a taper 188. Along the taper 188, the distance from the radial center of the projectile assembly 124 (which also corresponds to the shared point of contact between projectile portions 128*a*, 128*b*, 128*c*) to an outer surface 200 of the projectile portion 128 increases further away from the first leading edge 172. The taper 188 may stop at some location in the top portion 184. In some embodiments, the taper 188 is provided to ensure that the projectile assembly 124, when inserted into a casing 120, is capable of easily being chambered into any traditional rifled firearm. The taper 188 is traditional used to ensure a smooth delivery of the cartridge 108 from a magazine into the firing chamber of a firearm 100 or to ensure a smooth transition across the gap between a revolver firing chamber and the barrel of the revolver. In some embodiments, the taper 188 comprises the appropriate geometry to conform to rifled firearm standards, thereby making the cartridge 108 and projectile assembly 124 compatible with most types of rifled firearms 100.

Figure 15C:
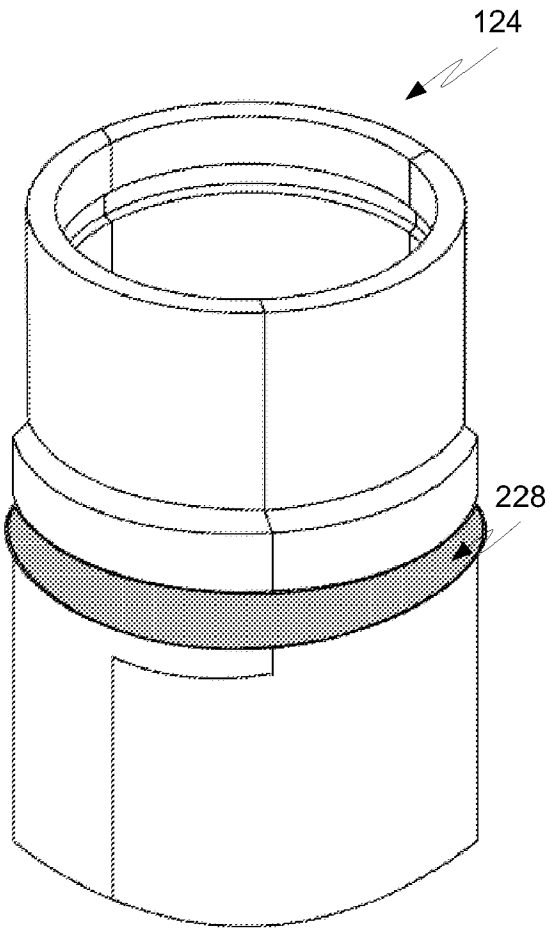
FIG. 15C is a perspective view of a projectile assembly having a restraint in accordance with embodiments of the present disclosure.
Figure 15B:
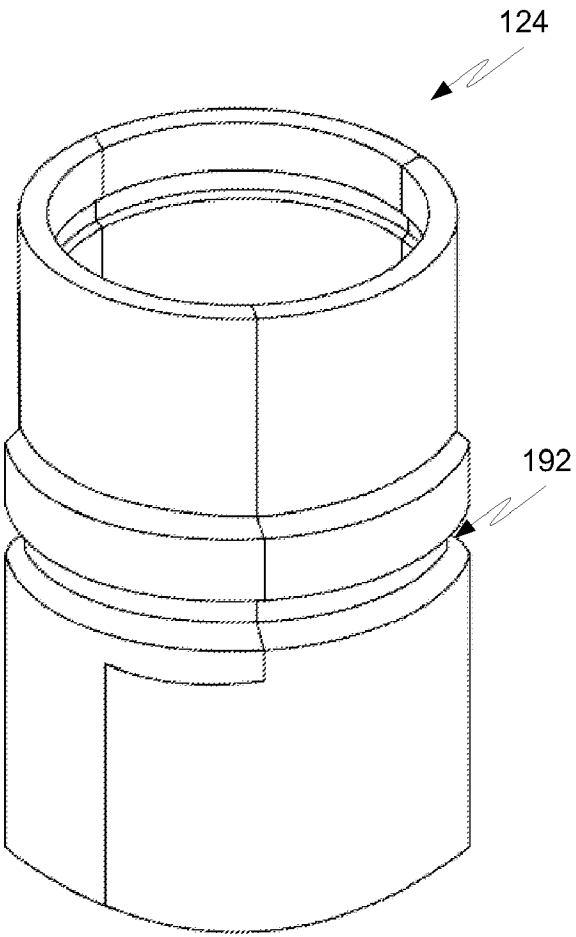
FIG. 15B is a perspective view of a projectile assembly having a circumferential notch in accordance with embodiments of the present disclosure.
Figure 15A:
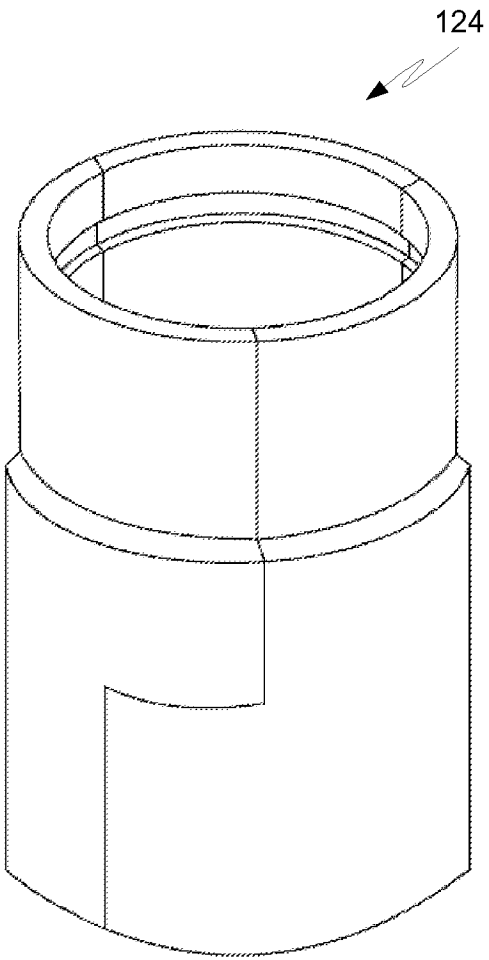
FIG. 15A is a perspective view of a projectile assembly without a notch in accordance with embodiments of the present disclosure.
Figure 16C:
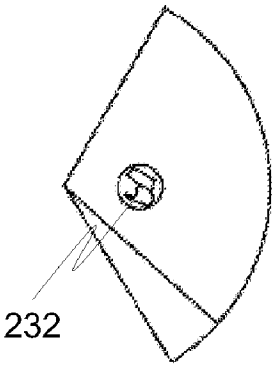
FIG. 16C is a bottom view of the projectile portion and tether depicted in FIG. 16A.
Figure 16D:
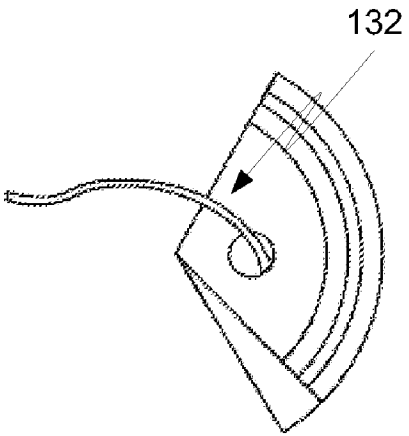
FIG. 16D is a top view of the projectile portion and tether depicted in FIG. 16A.
Figure 16B:
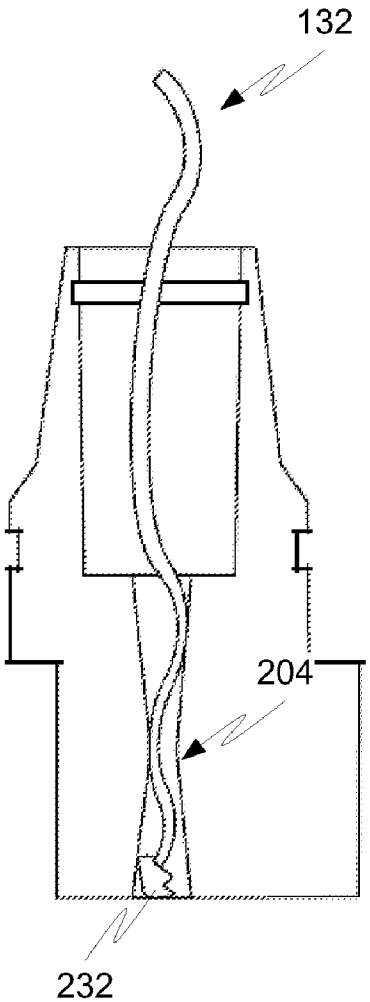
FIG. 16B is a side cross-sectional view of the projectile portion and tether depicted in FIG. 16A.
Figure 16A:
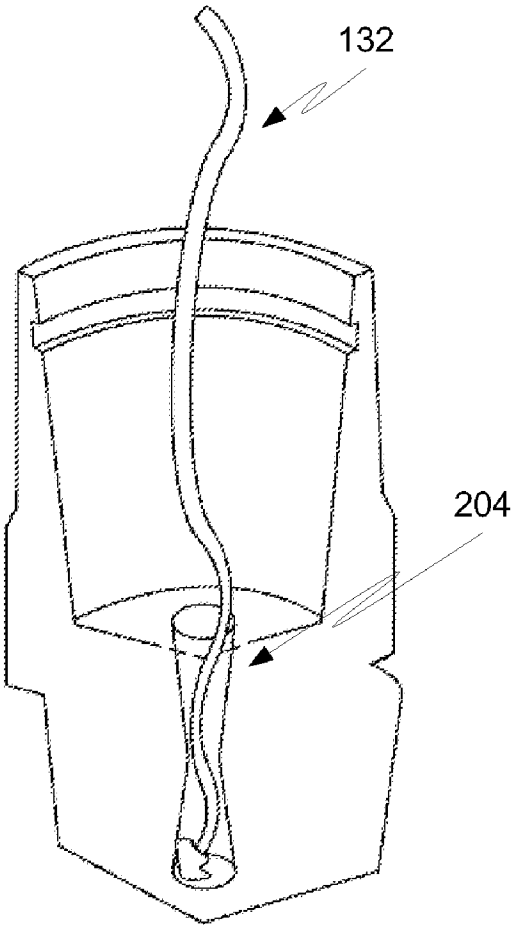
FIG. 16A is a perspective view of a projectile portion which also shows an enhanced view of a via receiving a tether in accordance with embodiments of the present disclosure.
Figure 17B:
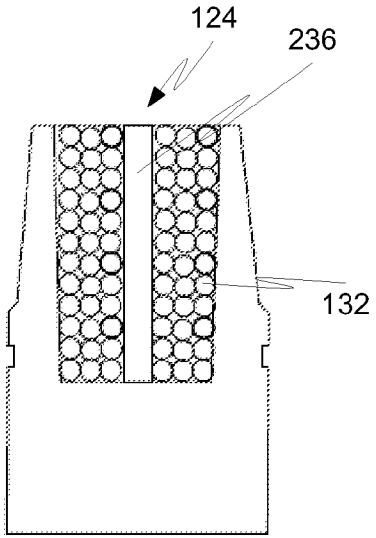
FIG. 17B is a cross-sectional view of the projectile assembly depicted in FIG. 17A.
Figure 17D:
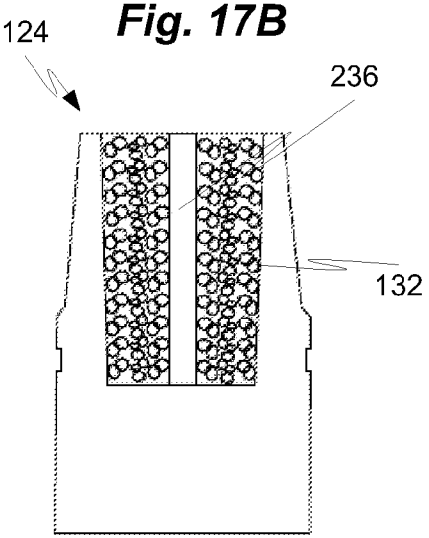
FIG. 17D is a cross-sectional view of the projectile assembly depicted in FIG. 17C.
Figure 17A:
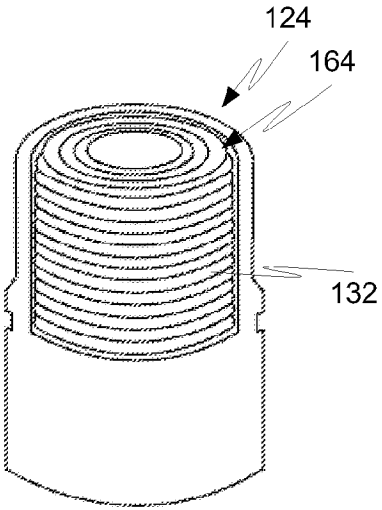
FIG. 17A is a perspective view of a projectile assembly which also shows an enhanced view of its upper cavity in which a tether is packed in accordance with embodiments of the present disclosure.
Figure 17C:
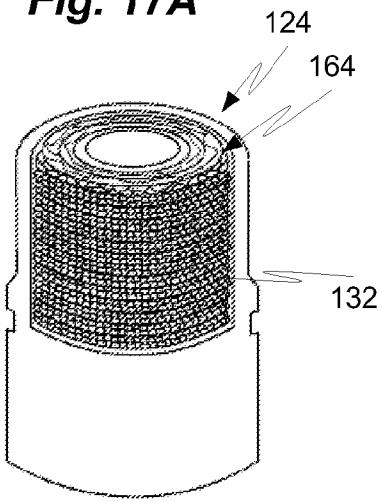
FIG. 17C is a perspective view of a projectile assembly which also shows an enhanced view of its upper cavity in which a chain-stitched tether is packed in accordance with embodiments of the present disclosure.

The projectile assembly 124 may also comprise a notch 192 which is a groove feature shared by all projectile portions 128*a*, 128*b*, 128*c*. The notch 192, in some embodiments, is configured to receive a restraint 228 as is shown in FIG. 15C. The restraint 228 may correspond to a circular-shaped material that is adapted to maintain a minimal force on the projectile portions 128*a*, 128*b*, 128*c* directed radially inward. The notch 192 and restraint 228 may be used to make the manufacture of the cartridge 108 easier and more efficient. It may be desirable, however, to use a projectile assembly 124 having a notch 192 and no restraint as is shown in FIG. 15B or no notch 192 as is shown in FIG. 15A. In some embodiments, the outer diameter of the restraint 228 is larger than the largest outer diameter of the projectile assembly 124 thereby creating a tighter gas seal between the projectile assembly 124 and the inner surface of the barrel 104.

The projectile assembly 124 may also comprise one or more locking features 196. The locking features 196 may correspond to a point where the projectile portions 128 interconnect such that forces applied at the bottom of the projectile assembly 124 do not result in a relative shift of the projectile portions 128. In some embodiments, the locking feature 196 corresponds to a stair-step feature which essentially precludes any relative shifting of the projectile portions along a central longitudinal axis (i.e., an axis along which the projectile assembly 124 travels in the barrel 104) of the projectile assembly 124.

Additional details of the locking features 196 are shown in FIGS. 12 and 13A-F. In particular, the locking features 196 may be positioned proximate to equator of the projectile portions 128. In some embodiments, the locking features 196 are located at or slightly above the center of rotation for each projectile portion 128. As can be seen in FIGS. 13A-F, the bottom portion 180 may interface with the top portion 184 of the projectile portion 128 at the locking feature 196. In some embodiments, the cross-sectional area of the top of the bottom portion 180 is equal to the cross-sectional area of the bottom of the top portion 184. However, the bottom portion 180 is offset or shifted relative to the top portion 184, thereby creating the locking feature 196. In some embodiments, the locking feature 196 may comprise a stair-step feature creating by exposing an upper surface of the bottom portion 180 and a bottom surface of the top portion 184. These exposed surfaces may be referred to as offset surfaces. An offset surface of a bottom portion 208 on a first projectile portion 128*a* may interface with an offset surface of a top portion 212 of a second projectile portion 128*b*. In a two-portion projectile assembly 124, these may be the only interfacing surfaces which create the locking feature 196. In a three-portion projectile assembly 124, however, an offset surface of a bottom portion 208 of the second projectile portion 128*b* may interface with an offset surface of a top portion 212 of a third projectile portion 128*c*. To complete the locking feature 196, an offset surface of a bottom portion 208 of the third projectile portion 128*c* may interface with an offset surface of a top portion 212 of the third projectile portion 128*a*, thereby establishing the locking feature 196.

Utilizing an offset between the bottom and top portions of the projectile portions 128 achieves two useful goals. First, the locking feature 196 can be created, thereby restricting the relative movement of the projectile portions 128 both in the casing 120 and in the barrel 104. Second, symmetry between all portions of the projectile assembly 124 is maintained. This enables the projectile assembly 124 to maintain a stable trajectory and allows the weight of each projectile portion 128 to counteract and equally apply a stopping force to other projectile portions in the projectile assembly 124 as the projectile assembly 124 decelerates the expanding segments.

In some embodiments, the locking feature 196 may comprise a configuration other than a stair-step feature. For example, the locking feature 196 may include one or more of slot and groove features, peg and hole features, interlocking teeth features, snaps, hooks, diagonal slopes, and so on.

Each projectile portion 128 may further include a via 204 which provides one way of interfacing the projectile portion 128 with the tether/braking system 132. Other possible ways of connecting the projectile portion 128 with a tether/braking system 132 include, but are not limited to, wrapping the tether/braking system 132 around some or all of the projectile portion 128, spot welding some of the tether/braking system 132 to a surface of the projectile portion 128, using a fastener or microfastener system to interconnect the tether/braking system 132 to the projectile portion 128, or the like.

Figure 14B:
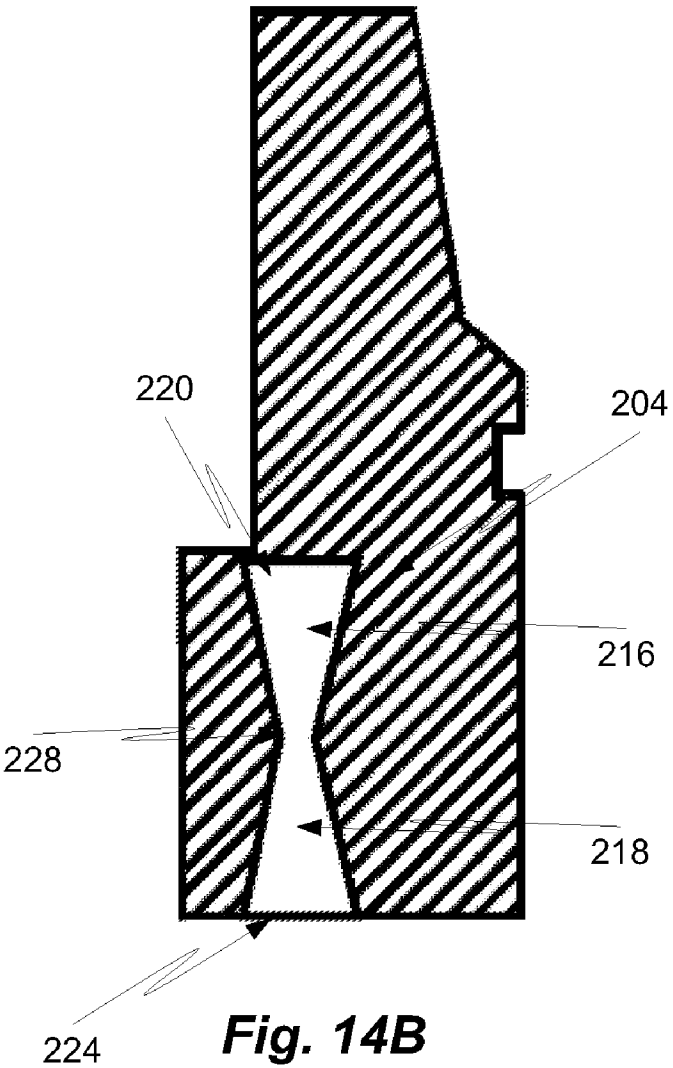
FIG. 14B is a second cross-sectional view of a projectile portion in accordance with embodiments of the present disclosure.
Figure 14A:
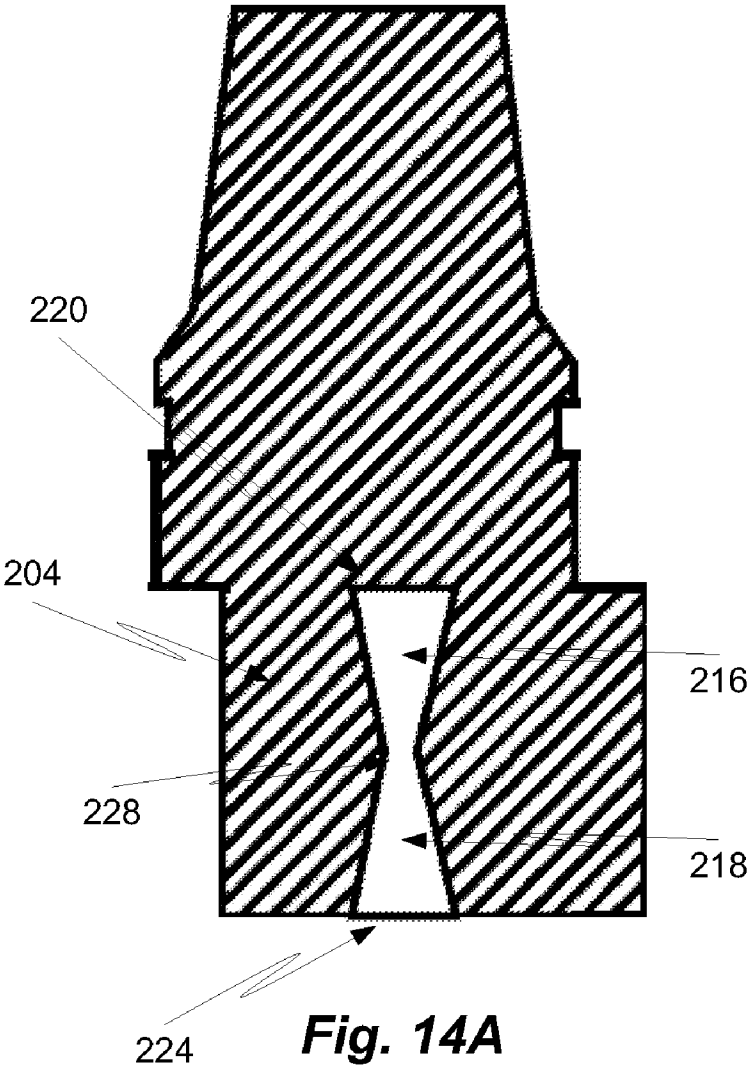
FIG. 14A is a first cross-sectional view of a projectile portion in accordance with embodiments of the present disclosure.

With reference now to FIGS. 14A-B, additional details of the via 204 will be described in accordance with at least some embodiments of the present disclosure. The vias 204 may comprise a first conical portion 216 having an opening 220 in the bottom of the cavity 164, a second conical portion 218 having an opening 224 in the trailing edge 176 and a choke point 228, which defines the interconnection between the first conical portion 216 and second conical portion 218.

In some embodiments, the radius of the first conical portion 216 is larger at the opening 220 than the radius of the first conical portion 216 at the choke point 228. Similarly, the radius of the second conical portion 218 is larger at the opening 224 than the radius of the second conical portion 218 at the choke point 228. This makes the choke point 228 correspond to the most narrow point within the via 204. The conical portions 216, 218 may be created by milling or machining the projectile portion 128 until the via 204 is created or during the formation of the portion 128. The orientation, size, and shape of the via 204 may vary depending upon the type of tether/braking system 132 being used, the type of material used to create the projectile portion 128, and other considerations. In some embodiments, the axis of the via 204 (i.e., the central axis of either conical portion 216, 218) may be orthogonal to both the bottom surface of the projectile portion 128 and the bottom surface of the cavity 164. In some embodiments, the axis of the via 204 may be angularly positioned relative to the bottom surface of the projectile portion 128. For example, the via 204 may be directed outward such that the opening 220 is closer to the center of the projectile assembly 124 whereas the opening 224 is closer to the outer surface 200 of the projectile assembly 124.

The location of the choke point 228 may be strategically positioned such that the point where the tether/braking system 132 applies a force to the projectile portion 128 is above the center of mass of the projectile portion 128. This allows the projectile portion 128 to individually rotate as the projectile assembly 124 move down range and achieve an optimal aerodynamic configuration for the individual projectile portion 128.

As can be seen in FIGS. 16A-D, the tether/braking system 132 may comprise a stopper 232 which interfaces with the choke point 228. In some embodiments, the width of the tether/braking system 132 may be smaller than the area of the choke point 228, thereby allowing the tether/braking system 132 to pass through the via 204 during the assembly process. However, the stopper 232 may be larger than the area of the choke point 228, thereby providing a point at which the tether/braking system 132 anchors to the projectile portion 128.

In some embodiments, the stopper 232 is created by first threading the tether/braking system 132 through the via 204. Thereafter, an amount of glue or some other material is added to the free end of the tether/braking system 132 and/or within the second conical portion 218 to function as a wedge. Any type of polymer or similar material may be used to create the stopper 232. Suitable examples of materials which may be used to create the stopper 232 include, without limitation, thermosetting polymers, ultra-violet activated polymers, steel, aluminum, and the like. It may also be possible to establish the stopper 232 by simply tying the free end of the tether/braking system 132 into one or more knots that increase the size of the tether/braking system 132 to a size larger than the area of the choke point 228. In some embodiments, the entire via 204 may be filled with a polymer, adhesive, glue, or the like to secure the tether/braking system 132 into the via 204.

With reference now to FIGS. 17A-D, one possible manner of packing the tether/braking system 132 into the upper cavity 164 of the projectile assembly 124 will be described in accordance with embodiments of the present disclosure. The tether/braking system 132 may comprise a plurality of arms, each of which interface with a different projectile portion 128. Accordingly, a projectile assembly 124 having two projectile portions 128*a* and 128*b* will comprise a tether/braking system 132 with two arms—one for each projectile portion 128. Similarly, a projectile assembly 124 having three projectile portions 128*a*, 128*b*, 128*c* will comprise a tether/braking system 132 with three arms.

The tether/braking system 132 may comprise a deformation brake 236 which provides the common point of connection between all arms of the tether/braking system 132. In some embodiments, the deformation brake 236 is simply a point where the arms of the tether/braking system 132 come together and are united by some mechanism (e.g., staple, glue, wrapping, twisting, tying a knot, etc.). In some embodiments, the deformation brake 236 comprises a plastic or paper sleeve within which a free end of each arm is inserted. In the embodiment depicted in FIGS. 17A-B, the arms of the tether/braking system 132 may be wound around the deformation brake 236 in a spool-like fashion. In the embodiment depicted in FIGS. 17C-D, a similar spooling technique may be used to package the tether/braking system 132 into the cavity 164, by the tethers of the tether/braking system 132 may be chain-stitched, thereby further compacting the tether/braking system 132. Certain known spooling techniques can be used to maximize the spool width-to-arm length ratio. The arms of the tether/braking system 132 may be wound around the deformation brake 236 after the arms have been secured to each projectile portion 128 but before the deformation brake 236 has been inserted into the upper cavity 164. It may also be possible to insert the deformation brake 236 into the upper cavity 164 and then spin the projectile portions 128 relative to the deformation brake 236, thereby creating the spool configuration of the tether/braking system 132.

A number of different tether/braking system 132 configurations may be utilized to further maximize the efficiency with which the space of the upper cavity 164 is utilized. Specifically, the tether/braking system 132 may be provided with a plurality of tether aims 240, one for each projectile portion 128. As one example, a first tether arm 240*a* may interface with a first projectile portion 128*a*, a second tether arm 240*b* may interface with a second projectile portion 128*b*, and a third tether arm 240*c* may interface with a third projectile portion 128*c*. The tether arms 240*a*, 240*b*, 240*c* may interconnect with one another at the deformation brake 236. In some embodiments, the length of each tether arm 240*a*, 240*b*, 240*c* is substantially the same within a machining tolerance.

Figure 18B:
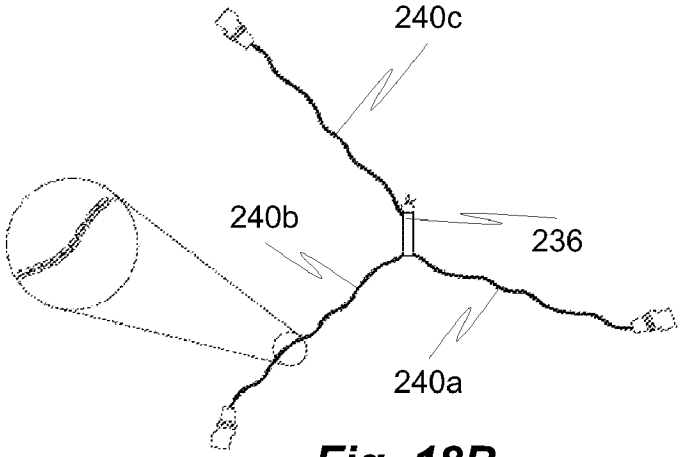
FIG. 18B depicts a second type of tether/restraint system used in a projectile assembly in accordance with embodiments of the present disclosure.
Figure 18C:
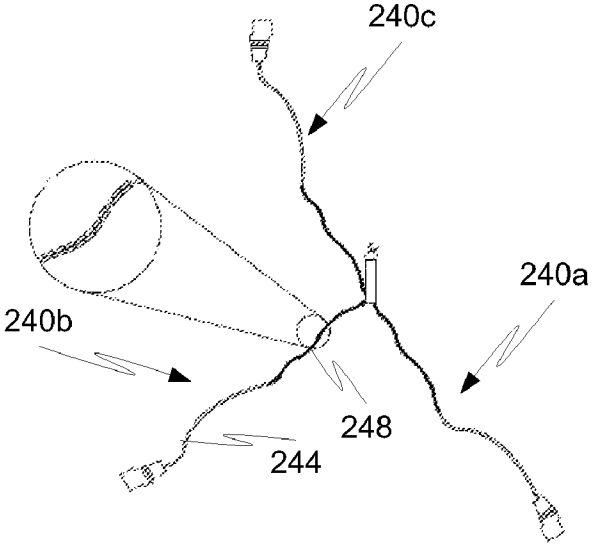
FIG. 18C depicts a third type of tether/restraint system used in a projectile assembly in accordance with embodiments of the present disclosure.
Figure 18A:
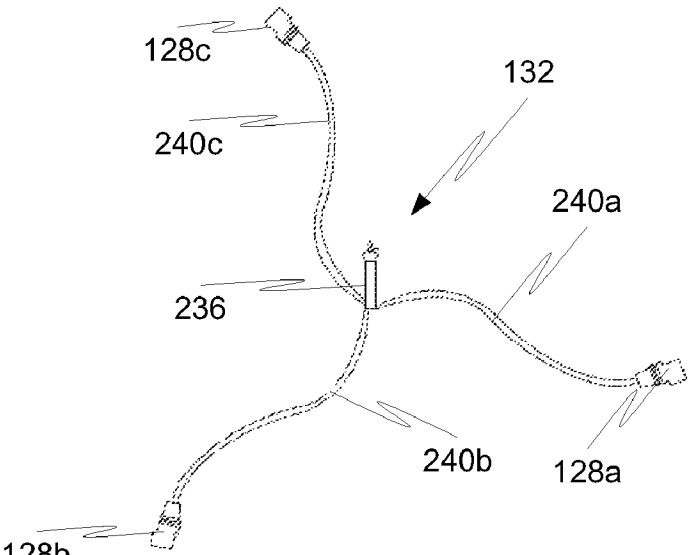
FIG. 18A depicts a first type of tether/restraint system used in a projectile assembly in accordance with embodiments of the present disclosure.

The tether/braking system 132 depicted in FIG. 18A comprises an unaltered tether material for each arm 240*a*, 240*b*, 240*c*. The tether/braking system 132 depicted in FIG. 18B comprises a chain-stitched configuration. In some embodiments, the tether/braking system 132 may be chain-stitched into a series of loops and folds (e.g., a chain stitch). Further details of a chain-stitched material and methods which may be employed to create the chain-stitched tether/braking system 132 of FIG. 18B are more fully described, for example, in U.S. Pat. No. 4,791,874 to Shiomi, the entire contents of which are hereby incorporated herein by reference.

Utilization of a chain stitch along the arms 240 of the tether/braking system 132 provides one way of compressing more tether/braking system 132 material into a smaller volume. Specifically, a 4:1 gain in packing efficiency and tangle reduction during deployment can be achieved by using the chain-stitched tether/braking system 132 as opposed to an unchain-stitched tether.

FIG. 18C depicts a tether/braking system 132 configuration whereby each tether arm 240 comprises a first section 244 and a second section 248. The first section 244 may comprise a straight tether arrangement whereas the second section 248 may comprise a chain-stitched tether arrangement. In some embodiments, the second section 248 is used to apply a first set of braking forces to each projectile portion 128. In contrast, the first section 244 is configured to allow the projectile portions 128 to accelerate radially away from the center of rotation 136 until the second section 248 begins to come under tension.

Figure 19:
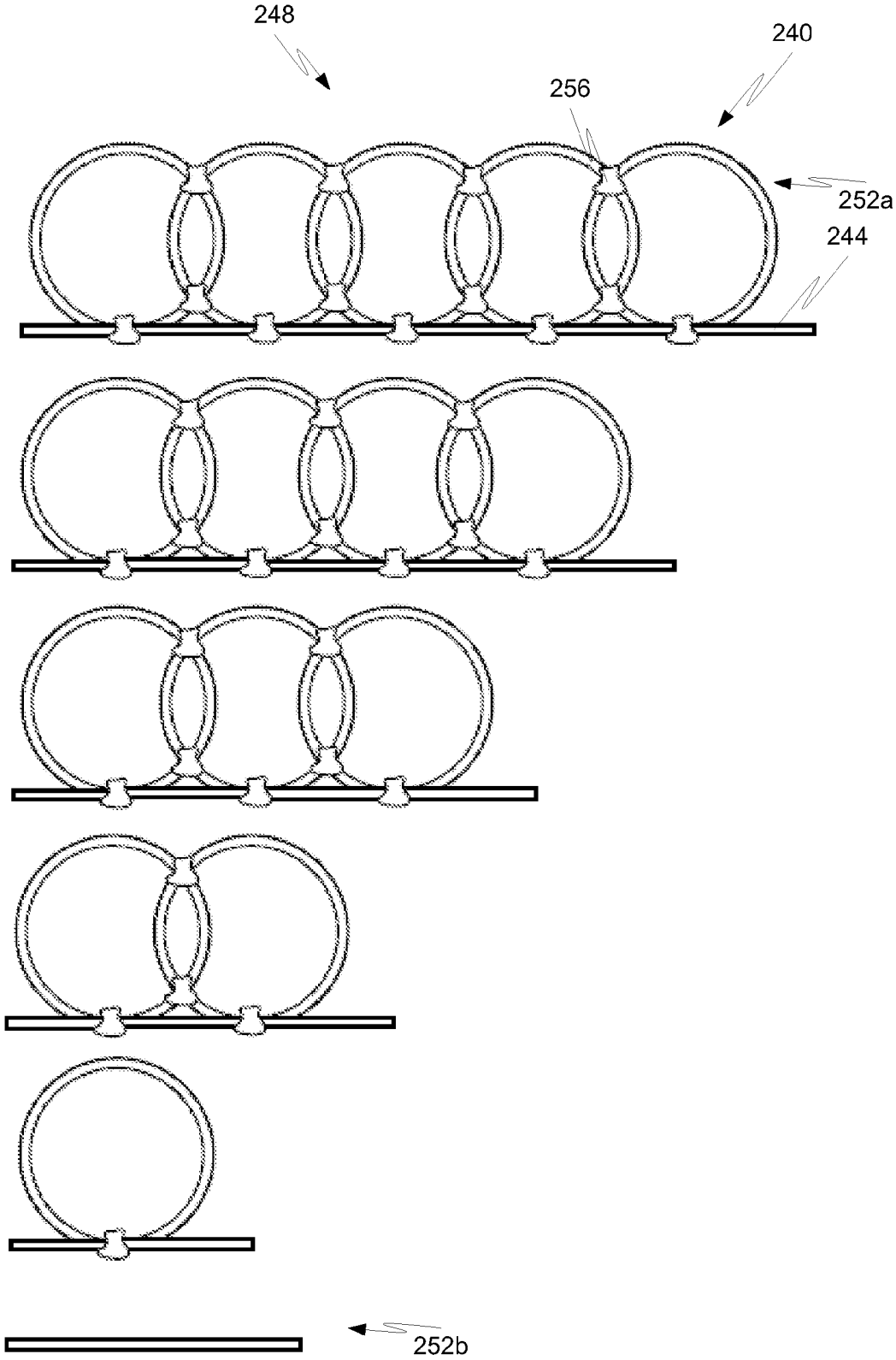
FIG. 19 shows a first sequence of tether configuration when sequential braking forces are applied by the tether to a projectile portion in accordance with embodiments of the present disclosure.
Figure 20:
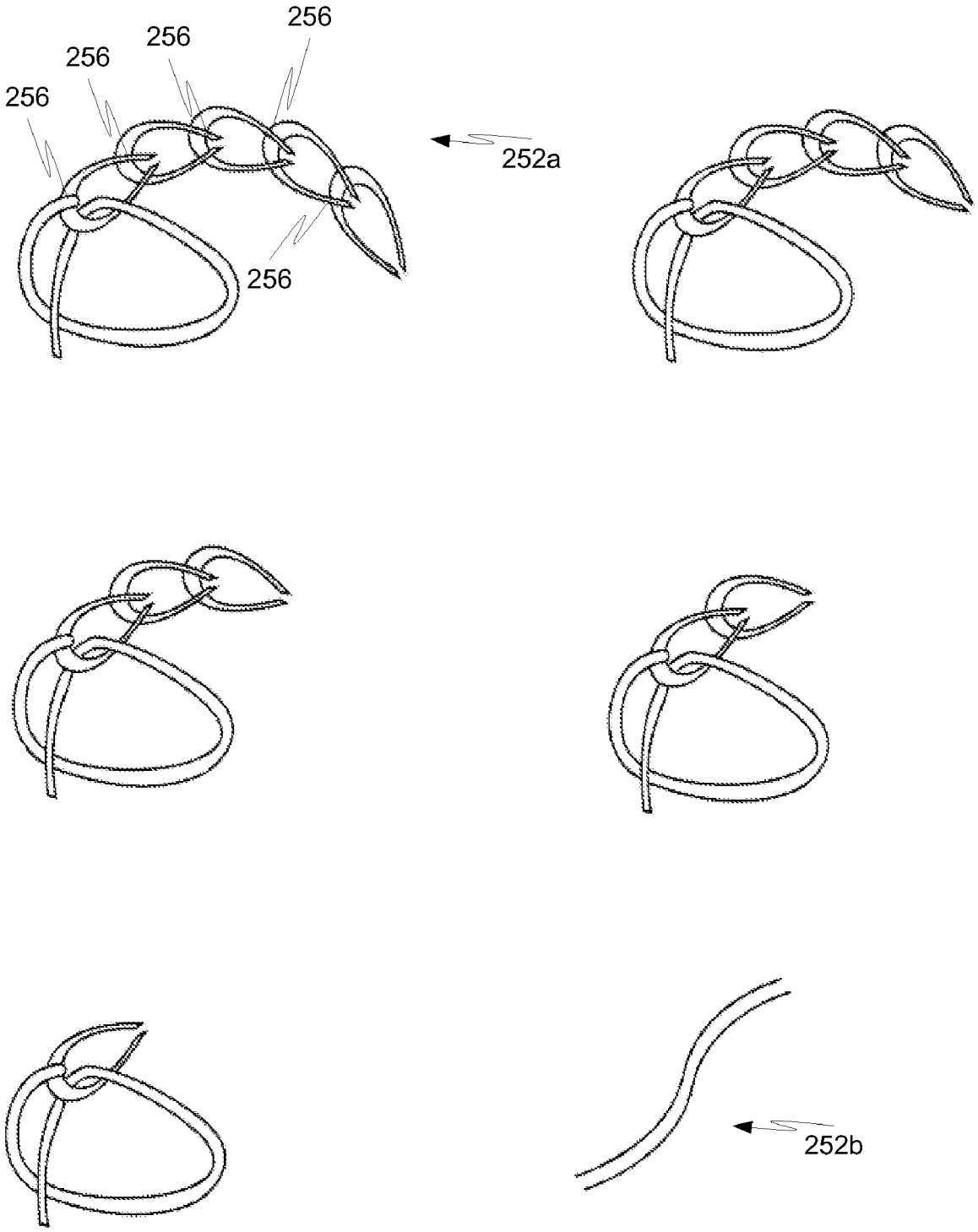
FIG. 20 shows a second sequence of tether configuration when sequential braking forces are applied by the tether to a projectile portion in accordance with embodiments of the present disclosure.
Figure 24:
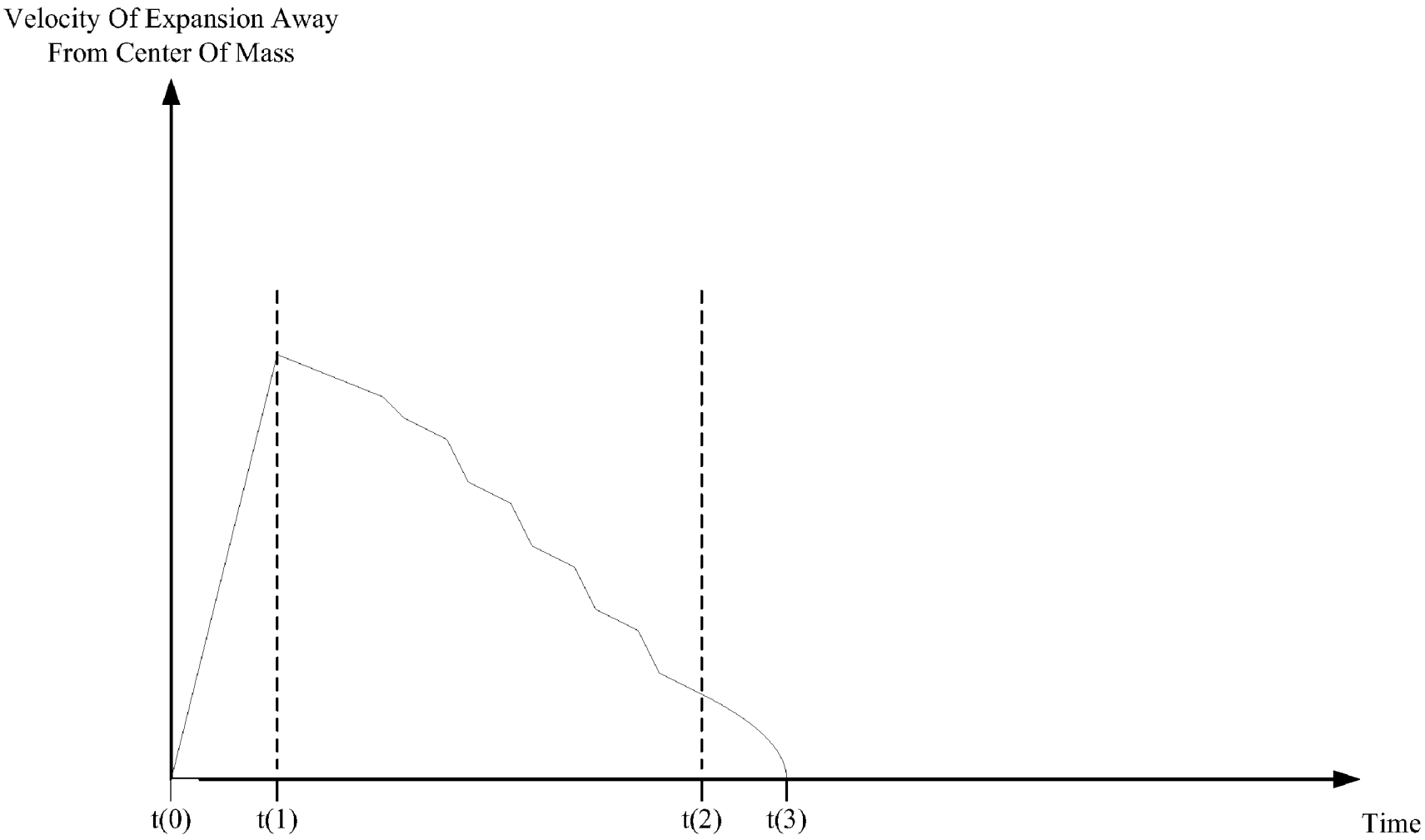
FIG. 24 is a graph depicting the velocity of radial expansion of the projectile assembly as a function of time after leaving a rifle barrel in accordance with embodiments of the present disclosure.

The advantages of using a second section 248 to apply sequential braking forces to the projectile portions 128 can be seen more readily with regards to FIGS. 19 and 20, where two potential configurations of the second section 248 are depicted. Referring initially to either FIG. 19 or 20 in combination with FIG. 24, a sequence of applying a set of braking forces to a projectile portion 128 via the tether/braking system 132 will be described. In particular, a loop-based configuration of the tether arms 240 is shown in FIG. 19 whereas a chain-stitched configuration of tether arms 240 is shown in FIG. 20.

The configuration shown in FIG. 19 achieves the braking applicators 256 by overlapping loops of the arm 240 and applying an epoxy or glue at the intersections (i.e., points where the tether arm 240 intersects itself). The bonds created by the braking applicators 256 at the overlapping points create a small point of resistance. By creating multiple points of resistance along the arm 240, the second section 248 is enabled to apply a set of braking forces to the projectile portions 128 which are strong enough to begin decelerating the projectile portions 128 but not so strong as to exceed the breaking strength of the tether or alter the trajectory of the projectile assembly 124.

The configuration shown in FIG. 20 is achieved by tying the material of the tether arm 240 into a chain stitch where a series of loops and hooks are used to create a compact tether arm 240 that is capable of being unraveled. Similar to the looping configuration, each point where the tether arm 240 intersects itself may be secured with a bonding agent to create a braking applicator 256. In contrast to the looping configuration, a chain-stitched configuration provides a larger number of overlapping connection points and, therefore braking applicators 256, across the same length of tether arm 240. Accordingly, a smaller amount of tether arm 240 can be used to apply similar braking forces as compared to an unchain-stitched configuration. As the tether arm 240 comes under tension, the bonding agents at each braking applicator 256 is sequentially broken in order to slow down the rate at which the projectile assembly 124 is expanding.

A further alternative configuration leverages the spooled assembly depicted in FIGS. 17A-D. In a spooled assembly, the entire length of the tether arms 240 may be coated in an adhesive or similar material. Therefore, extended lengths of the tether arm 240 may intersect portions of the spool, meaning that a continuous or semi-continuous braking force is applied by a braking applicator 256 that is substantially longer than the braking applicators 256 depicted in FIGS. 18 and 19. As can be appreciated, combinations of the above-described configurations of the tether/restraint system 132 and the braking applicator 256 may be used without departing from the scope of the present disclosure.

Upon initial deployment in either configuration, the first section 244 of each tether arm 240 may be a first length and the second section 248 of each tether arm 240 may be a second length. As can be seen, the second section 248 of each tether arm 240 may comprise a number of braking applicators 256. Before a first point in time 252*a* (t(1)) the second section 248 of the tether arms 240 are not under tension and the projectile portions 128 are accelerating radially away from the center of rotation 136 of the projectile assembly 124. However, after the first point in time 252*a* (t(1)), the second section 248 comes under tension and the tether/braking system 132 begins applying a first set of braking forces to each projectile portion 128 by way of the braking applicators 256 and the opposing pulling force(s) of other projectile portions 128 in the projectile assembly 124. The sequential breaking of each braking applicator 256 causes the velocity with which each projectile portion 128 is radially expanding to decrease.

Before a second point in time 252*b* (t(2)) the braking applicators 256 continue to be sequentially broken and the first section 244 becomes longer than its original length whereas the second section 248 becomes shorter than its original length. As the projectile portions 128 continue to pull on one another, additional braking applicators 256 are broken until either all braking applicators 256 are broken or the outward movement of section 128 has been fully arrested. In the event all breaking applicators 256 are broken and additional radial deceleration of the projectile portions 128 is needed a final stage of the tether/breaking system applies a braking force via the deformation brake 236.

Figures 21A, 21B, 21C:
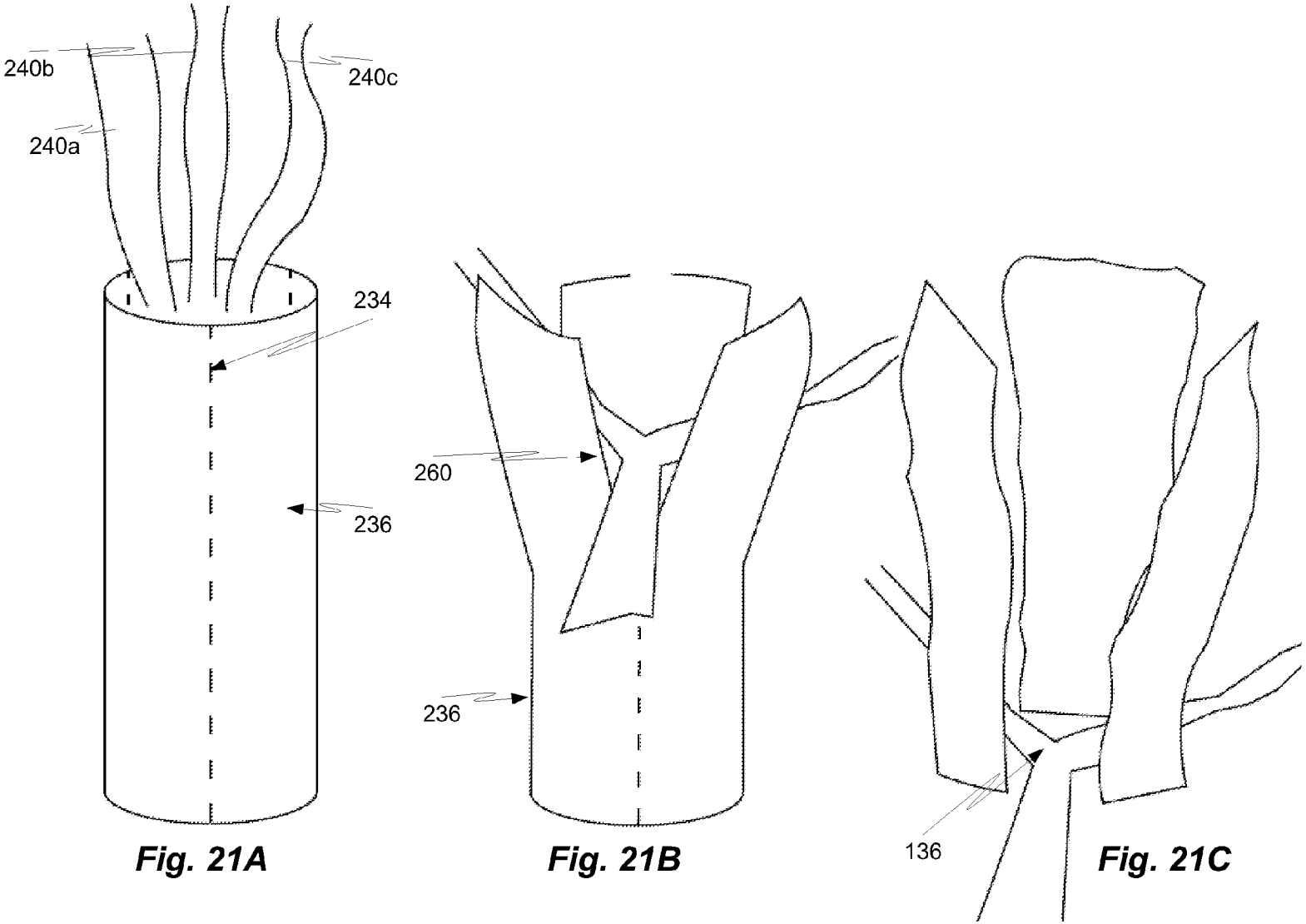
FIG. 21A is a perspective view of an unbroken deformation brake in accordance with embodiments of the present disclosure.
FIG. 21B is a perspective view of a partially broken deformation brake in accordance with embodiments of the present disclosure.
FIG. 21C is a perspective view of a fully broken deformation brake in accordance with embodiments of the present disclosure.

As can be seen in FIG. 21A-C, after all braking applicators 256 have been broken, any additional expansion of the projectile assembly 124 is stopped with the deformation brake 236. In particular, the deformation brake 236 applies a constant braking force equally to all projectile portions 128 after the second point in time 252*b* (t(2)). The second braking force is applied as the arms 240 induce faults 260 into the deformation brake 236. The faults 260 may correspond to partial tears or complete tears at which point the center of rotation 136 of the projectile assembly 124 becomes the intersection of the arms 240 rather than the deformation brake 236. The type of material used to construct the deformation brake 236 may vary depending upon the mass of each projectile portion 128, the type of material used for the tether/braking system 132, and the number of braking applicators 256 provided along each length of tether arm 240. Exemplary materials suitable for use with the deformation brake 236 include one or more of wax, paraffin, plastic, glue, other polymers, and paper. Furthermore, perforations 234 or similar faults may be designed into the deformation brake 236 to assist the deformation brake 236 in deforming according to a predetermined pattern. In some embodiments, the location of the perforations 234 are selected to control the locations where the faults 260 occur.

Figure 22:
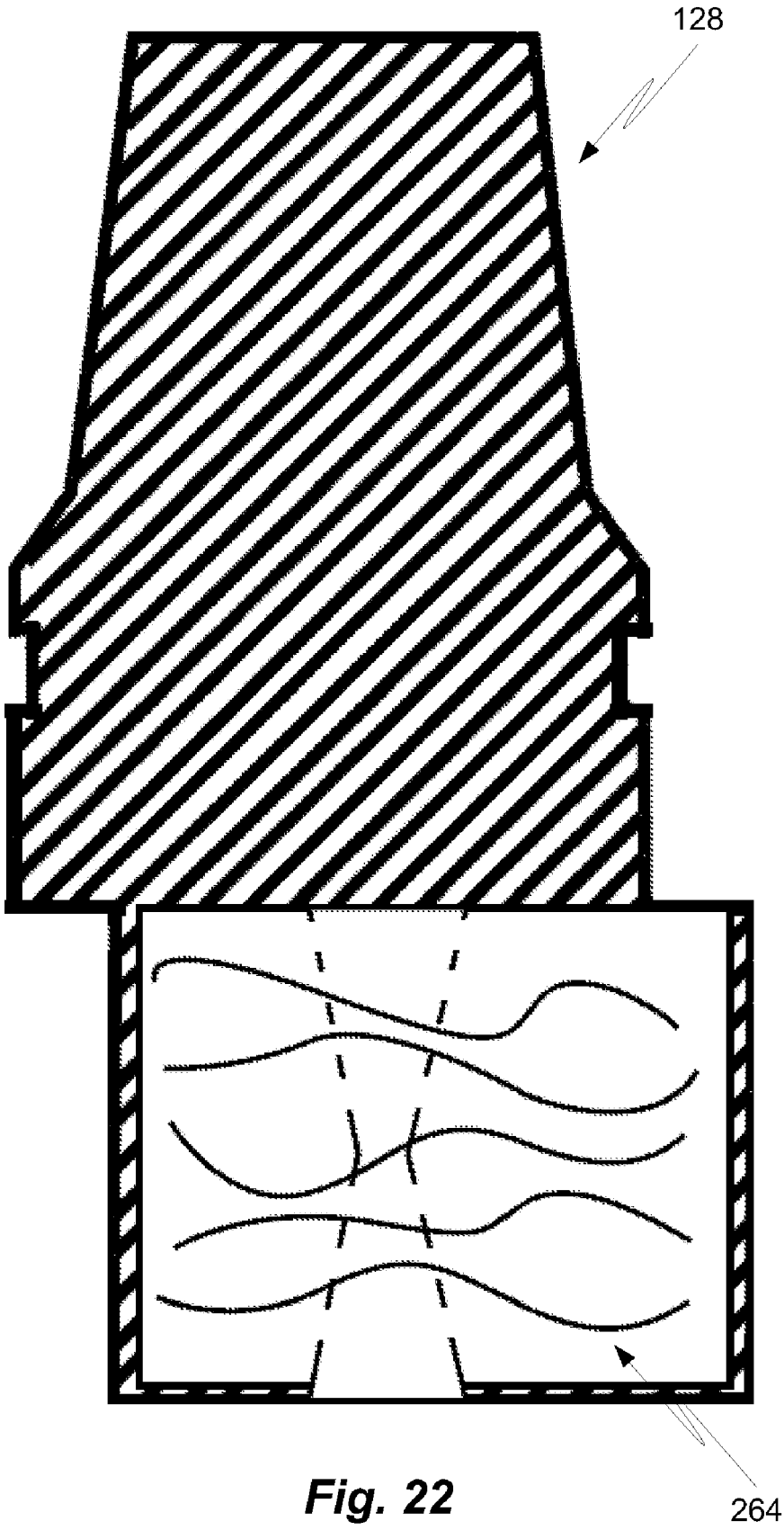
FIG. 22 is a cross-sectional view of a projectile portion having a cavity in its lower portion for storage and delivery of an alternative payload in accordance with embodiments of the present disclosure.

With reference now to FIG. 22, a projectile portion 128 comprising an additional chamber 264 in its bottom portion 180 will be described in accordance with at least some embodiments of the present disclosure. The projectile portion 128 may be configured to carry a payload of material (in a liquid, gas, or solid state) other than the material used to construct the projectile portion 128. In some embodiments, the projectile portion 128 may be constructed of a material that breaks upon impact, thereby releasing the payload contained within the additional chamber 264. In some embodiments, the additional chamber 264 may carry a crowd-control material or composition of matter. As one example, the additional chamber 264 ma carry tear gas, mace, pepper spray, or some other material known to be used in crowd-control applications a capacitor for the discharge of an electric shock. As another example, the additional chamber 264 may carry paint or similar marking materials used in paintball and similar games. If one projectile portion 128 of the projectile assembly 124 is provided with the additional chamber 264, then the other projectile portions 128 may also comprise the additional chamber 264 and payload material, thereby maintaining symmetry of the projectile assembly 124.

Figure 23B:
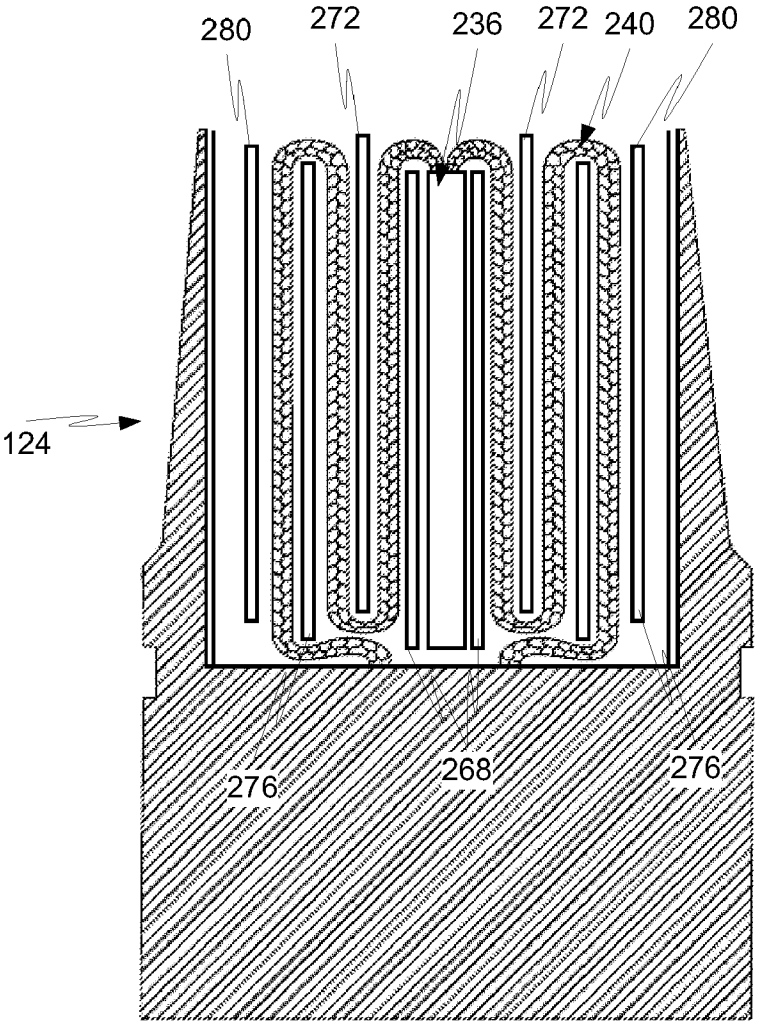
FIG. 23B is a cross-sectional view depicting another possible configuration of packing a tether/restraint system within a cavity of a projectile assembly in accordance with embodiments of the present disclosure.
Figure 23A:
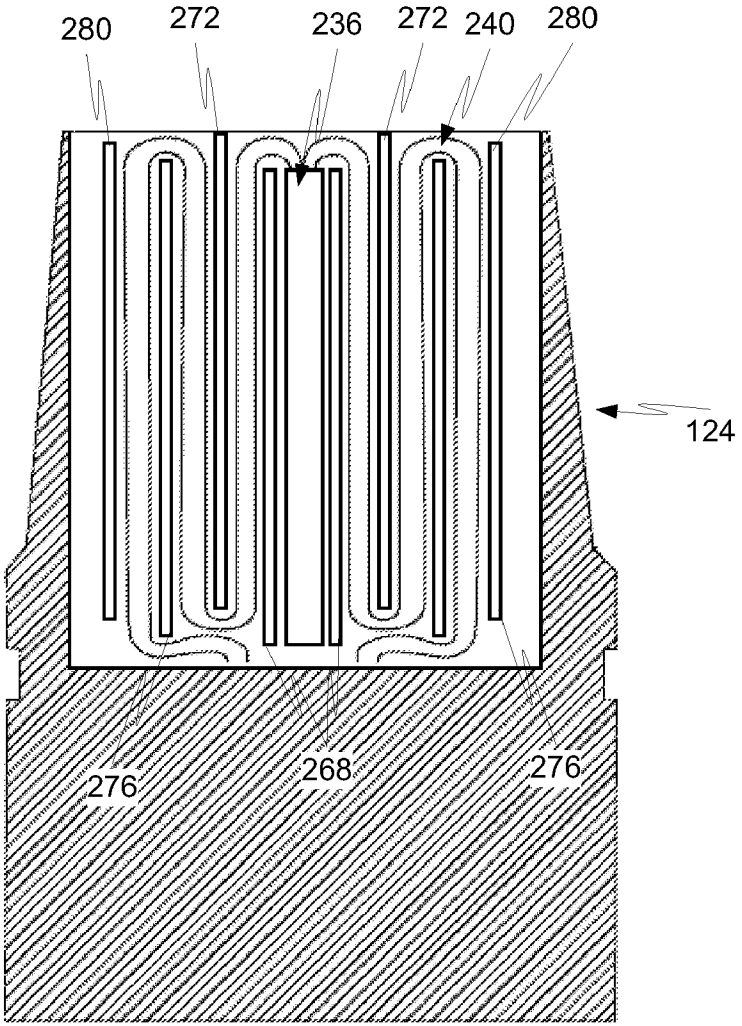
FIG. 23A is a cross-sectional view depicting one possible configuration of packing a tether/restraint system within a cavity of a projectile assembly in accordance with embodiments of the present disclosure.

With reference now to FIGS. 23A-B, an example of utilizing a series of sleeves to fold the tether arms 240 within the upper cavity 164 is depicted. The embodiment depicted in FIG. 23A corresponds to an embodiment where a plain tether is used to construct the tether/braking system 132. The embodiment depicted in FIG. 23B corresponds to an embodiment where a chain-stitched tether is used to construct the tether/braking system 132.

In some embodiments, the tether/braking system 132 utilizes a deformation brake 236 similar to the other tether/braking system 132 configurations discussed herein. Whether or not it is used in conjunction with a series of braking applicators 256, the tether/braking system 132 may comprise a series of sleeves (e.g., first sleeve 268, second sleeve 272, third sleeve 276, fourth sleeve 280, etc.) which contain the tether arms 240. In particular, the tether arms 240 may be folded over themselves and then wrapped in another sleeve. The sequential folding and wrapping of the tether arms 240 within each sleeve provides not only a way to compactly contain the tether/braking system 132 within the upper cavity 164 but also provides a way to minimize tangles and knots in tether/braking system 132 during assembly and deployment of the projectile assembly 124.

In some embodiments, the sleeves provide a third function of acting as braking applicators 256 as the projectile assembly 124 expands. More specifically, as the projectile portions 128 of the projectile assembly 124 begin to expand away from one another, the outer-most sleeve 280 may either slide off of the tether/braking system 132, become ripped by the tether arms 240, or apply some other resistive force to the expanding projectile portions 128. After the outer-most sleeve 280 has slid off or been completely torn, the next outer-most sleeve 276 may begin to slide off of the tether/braking system 132, become ripped by the tether arms 240, or apply some other resisitive force to the expanding projectile portions 128. Again, after that sleeve 276 has become separated from the tether/braking system 132, the next outer-most sleeve 272 will slide off, become ripped, or apply some other type of resistive force to the expanding projectile portions 128. Each sleeve applies a braking force to the projectile portions 128 as they expand away from the center of rotation 136 and the sequential application of forces by each sleeve is similar to the first set of braking forces applied to the projectile portions 128 by the braking applicators 256. This process continues until all sleeves have been discarded, ripped, etc. at which point other stages of braking forces (e.g., braking applicators 256 and/or deformation brake 236 are applied to the projectile portions 128 until the radial expansion of the projectile portions 128 is stopped allow the ever present centrifugal force to lock the portions 128 into a gyroscopically stable orbit.

As can be appreciated, the number of sleeves used to package the tether/braking system 132 may vary depending upon whether or not the tether arms 240 are normal or chain-stitched or looped back, depending upon the type of material used in constructing the tether/braking system 132 and tether arms 240, depending upon how many projectile portions 128 and arms 240 are included in the projectile assembly 124, and so forth.

Figure 25:
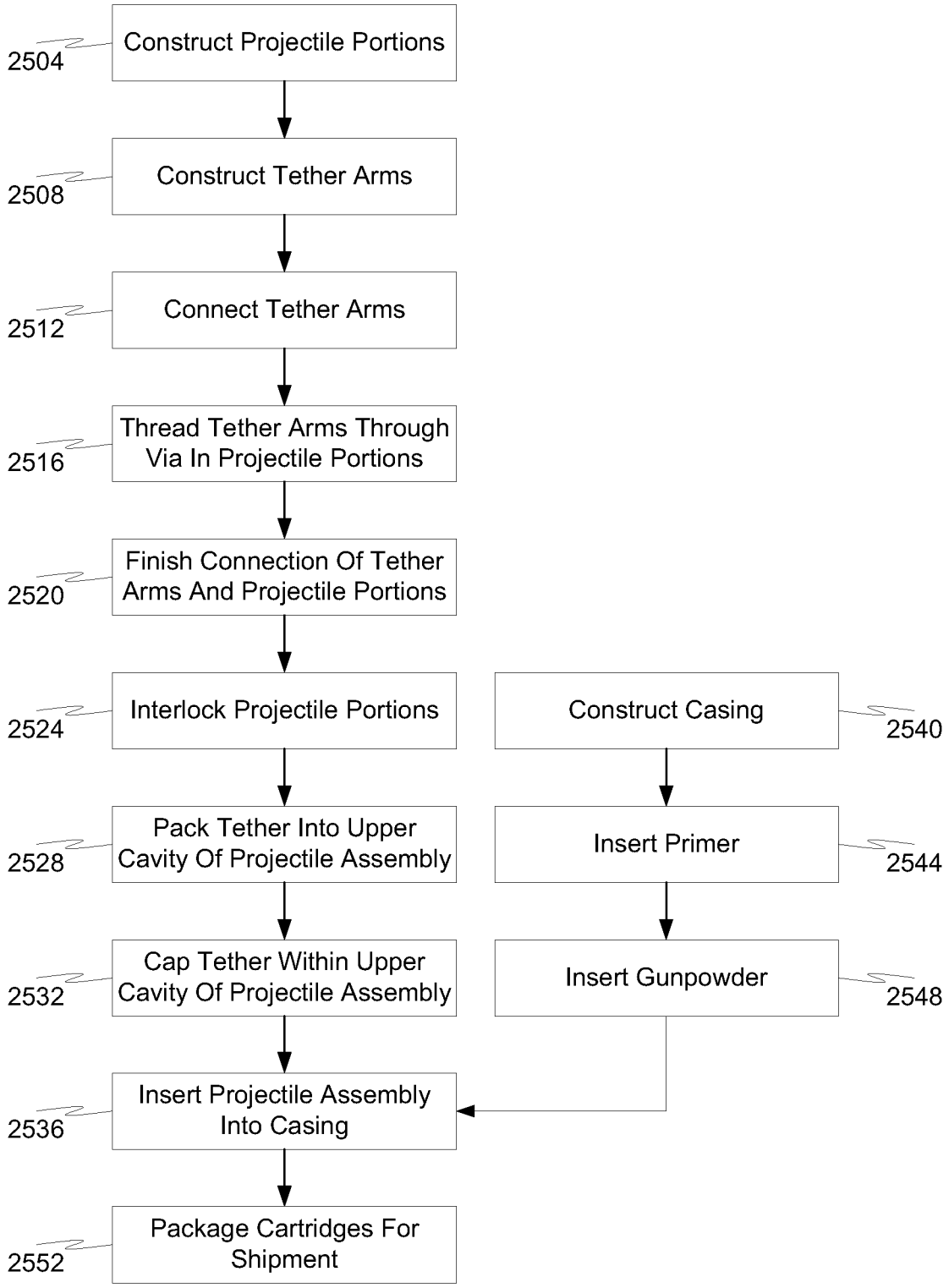
FIG. 25 is a flow chart depicting a cartridge manufacturing and packaging process in accordance with embodiments of the present disclosure.

With reference now to FIG. 25, a process of constructing the cartridges 108 and preparing the same for distribution will be described in accordance with at least some embodiments of the present disclosure. Although the process described herein depicts the process steps as being performed in a particular order, one of ordinary skill in the art will appreciate that a different order of process steps may be followed without departing from the scope of the present disclosure. Moreover, certain steps may be combined, performed in parallel, or eliminated depending upon how each step is performed and depending upon the features of the cartridge 108 desired.

The process, in one embodiment, begins with the construction of the projectile portions 128 for a cartridge 108 (step 2504). In some embodiments, the projectile portions 128 may be die-cast, forged, machined, or manufactured according to any known type of manufacturing process.

The process also includes a step of constructing the tether arms 240 (step 2508). As can be appreciated, the steps followed in the preparation of the tether arms 240 will depend upon the configuration of tether/braking system 132 being used. In particular, if a fully chain-stitched or partially chain-stitched tether arm 240 is being employed, then the material of the tether/braking system 132 may be chain stitched and cut to predetermined lengths.

The tether arms 240 are then connected together at the deformation brake 236 (step 2512) and then each tether arm 240 is threaded though a via 204 in a corresponding projectile portion (step 2516). The connection between the tether/braking system 132 and the projectile portions 128 are completed after the tether arms 240 have been threaded through the projectile portions 128 (step 2520). In some embodiments, the free end of the tether arm 240 is glued within the via 204, tied into a knot, wedged into place or caused to become larger than the via 204 in some manner.

Each projectile portion 128 of the projectile assembly 124 is then interlocked (step 2524) thereby creating the upper cavity 164 of the projectile assembly 124. The remainder of the tether/braking system 132 is then packed into the upper cavity 164 of the projectile assembly 124 (step 2528). In some embodiments, this step may involve winding the tether/braking system 132 into the upper cavity 164 or folding the tether arms 240 into a series of sleeves, which are subsequently inserted into the upper cavity 164. After the tether/braking system 132 is positioned within the upper cavity 164, the upper cavity 164 may be capped 168, thereby sealing the tether/braking system 132 within the projectile assembly 124 (step 2532).

In another part of the process, the casing 120 may be created (step 2540). The steps used to construct the casing 120 may be similar or identical to steps used to construct traditional rifling casings.

After the casing 120 has been constructed, the primer (step 2544) and gunpowder (step 2548) are inserted into the casing 120 in no particular order. The completed projectile assembly 124 is then inserted into the casing 120 to complete construction of the cartridge 108 (step 2536). In some embodiments, the complete cartridge 108 may be packaged with a plurality of other cartridges 108 into a box for shipping (step 2552), unless the cartridge 108 is to be distributed on a per-cartridge basis or distributed in some other manner.

As noted above, various materials and component designs may be varied to provide projectile assemblies 124 and cartridges 108 for specific purposes. In some embodiments, different configurations of cartridges 108 may be loaded in a magazine of a firearm 100 in an intelligent sequence. The intelligent sequence may utilize cartridges 108 of different configurations to achieve certain desired results. As an example, a sequence of cartridges 108 may be loaded where a first cartridge 108 fired corresponds to a stun-type configuration (e.g., a projectile assembly 124 with relatively lightweight projectile portions 128 and heavier tether/braking system 132 fired at a relative low velocity), a second cartridge 108 fired corresponds to a knock-down-type configuration (e.g., a projectile assembly with heavier projectile portions 128 and lighter tethers 132 fired at a higher velocity), and a third cartridge 108 fired corresponds to a lethal-type configuration (e.g., where the tether/braking system 132 is designed to break apart upon impact and the projectile portions 128 are of a substantially heavier configuration shot at a high velocity). Utilization of intelligent cartridge sequences enables a series of rounds to be fired in order to achieve certain tactical advantages or adapt a single firearm 100 to many different types of environments and use cases.

The foregoing description of the present invention has been presented for purposes of illustration and description. Furthermore, the description is not intended to limit the invention to the form disclosed herein. Consequently, variations and modifications commenced here with the above teachings and the skill or knowledge of the relevant art are within the scope in the present invention. The embodiments described herein above are further extended to explain best modes known for practicing the invention and to enable others skilled in the art to utilize the invention in such, or other, embodiments or various modifications required by the particular applications or uses of present invention. It is intended that the dependent claims be construed to include all possible embodiments to the extent permitted by the prior art.

What is claimed is:

1. A multi-projectile assembly, comprising:

at least a first projectile portion;

at least a second projectile portion; and a multi-staged radial braking and tether restraint system that interconnects the at least a first and second projectile portions such that spin-generated forces imparted on the assembly cause the at least a first and second projectile portions to radially expand away from their original center of rotation up to a finite expansion limit defined by the multi-staged radial braking and tether restraint system wherein the multi-staged radial braking and tether restraint system applies substantially no resistance to the at least a first and second projectile portions until they have moved a first predetermined radial distance away from their original center of rotation at which point the multi-staged radial braking and tether restraint system begins applying a second force greater than the substantially no resistance to the at least a first and second projectile portions causing the at least a first and second projectile portions to expand from center at a decreasing rate of speed until the finite expansion limit is reached.

2. The multi-projectile assembly of claim 1, wherein the at least a first and second projectile portions are arranged in a circular array, wherein the at least a first and second projectile portions are symmetrical such that they interconnect with one another primarily along their major axis and also in a second direction via male and female mating features.

3. The multi-projectile assembly of claim 1, where the at least a first and second projectile portions are symmetrical, wherein the at least a first and second projectile portions are arranged in the circular array such that they interconnect with one another primarily along their major axis and also in a second direction via at least one stair-step feature.

4. The multi-projectile assembly of claim 1, wherein the at least a first and second projectile portions interconnect with one another such that a cavity is formed between the at least a first and second projectile portions, the cavity being configured to house the multi-staged radial braking and tether restraint system in substantially the upper half of the at least a first and second projectile portions, and wherein the at least a first and second projectile portions further interconnect with one another in such a way that the at least a first and second projectile portions are configured to exit a barrel of a gun simultaneously.

5. The multi-projectile assembly of claim 1, wherein the at least a first and second projectile portions expand away from their original center of rotation substantially within a single plane of expansion and wherein a trajectory of the multi-projectile assembly is substantially orthogonal to the plane of expansion.

6. The multi-projectile assembly of claim 1, further comprising at least a third projectile portion, wherein the multi-staged radial braking and tether restraint system interconnects the at least a first, second, and third projectile portions.

7. The multi-projectile assembly of claim 6, further comprising no more than five projectile portions, wherein the multi-staged radial braking and restraint system interconnects the projectile portions of the multi-projectile assembly.

8. The multi-projectile assembly of claim 1, wherein the at least a first and second projectile portions each comprise an anchor point where the multi-staged radial braking and tether restraint system applies forces to the projectile portion and wherein the anchor point is offset from a center of mass of the projectile portion thereby allowing each projectile portion to independently rotate and achieve an independent optimal aerodynamic position upon reaching the expansion limit.

9. The multi-projectile assembly of claim 1, wherein the at least a first and second projectile portions comprise at least one of a notch and groove on their outer surface configured to receive a restraint that holds the multi-projectile assembly together during manufacturing of the multi-projectile assembly.

10. A cartridge including the multi-projectile assembly of claim 1.

11. A multi-staged radial braking and tether restraint system as claimed in claim 1, wherein the multi-staged radial braking and tether restraint system comprises at least a first stage that is a tether which applies the substantially no resistance prior to the at least a first and second projectile portions reaching the first predetermined radial distance, wherein the tether also applies forces larger than the substantially no resistance when the tether is under tension, wherein the multi-staged radial braking and tether restraint system also comprises at least a second stage that includes a plurality of braking applicators established on the tether and braking system, and wherein the multi-staged radial braking and tether restraint system enables the projectile assembly to benefit from gyroscopic stabilization at all phases of braking by systematically dissipating the radial pulling forces thereby mitigating the occurrence of destabilization caused by bounce back.

12. The multi-staged radial braking and tether restraint system of claim 11, wherein the at least a first stage comprises a tether made of a pliable thread-like material.

13. The multi-staged radial braking and tether restraint system of claim 11, wherein the plurality of braking applicators comprise a plurality of knots established on the tether and wherein the plurality of braking applicators do not apply a substantial force to the at least a first and second projectile portions until after the first and second projectile portions have moved the first predetermined radial distance away from their original center of rotation.

14. The multi-staged radial braking and tether restraint system of claim 13, wherein the at least a second stage further comprises a deformation brake.

15. The multi-staged radial braking and restraint system of claim 14, wherein the deformation brake comprises at least one of an adhesive, a sleeve, and a knot.

16. The multi-staged radial braking and tether restraint system of claim 13, wherein the tether is looped and laid back onto itself and the braking applicators comprise a breakable bond created at points of contact where the tether touches itself.

17. The multi-staged radial braking and tether restraint system of claim 13, wherein the tether is configured in such a way that consecutive loops are pulled through one after another and the braking applicators comprise a breakable bond created along points of contact where the tether touches itself.

18. The multi-staged radial braking and tether restraint system of claim 13, wherein the tether is spooled and wherein the braking applicators apply a continuous braking force to the at least a first and second projectile portions after the at least a first and second projectile portions have moved the first predetermined radial distance away from their original center of rotation.

* * * * *